US008469507B2

(12) United States Patent
Fukui

(10) Patent No.: US 8,469,507 B2
(45) Date of Patent: Jun. 25, 2013

(54) MEDIUM HOLDING APPARATUS AND IMAGE FORMING APPARATUS

(75) Inventor: Takashi Fukui, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 224 days.

(21) Appl. No.: 12/847,024

(22) Filed: Jul. 30, 2010

(65) Prior Publication Data

US 2011/0025807 A1 Feb. 3, 2011

(30) Foreign Application Priority Data

Jul. 31, 2009 (JP) ..... 2009-179873

(51) Int. Cl.

| | |
|---|---|
| ***B41J 2/01*** | (2006.01) |
| ***B41J 2/175*** | (2006.01) |
| ***B41J 2/325*** | (2006.01) |
| ***B41J 2/455*** | (2006.01) |
| ***B41J 2/435*** | (2006.01) |

(52) U.S. Cl.

USPC ..... 347/104; 347/85; 347/222; 347/233; 347/262

(58) Field of Classification Search

None

See application file for complete search history.

(56) References Cited

U.S. PATENT DOCUMENTS

| | | | | |
|---|---|---|---|---|
| 4,237,466 | A * | 12/1980 | Scranton | 347/104 |
| 6,002,419 | A * | 12/1999 | Kerr et al. | 347/233 |
| 6,854,836 | B2 * | 2/2005 | Ishinaga et al. | 347/85 |

FOREIGN PATENT DOCUMENTS

| | | | |
|---|---|---|---|
| JP | 02-291762 | A | 12/1990 |
| JP | 08-002738 | A | 1/1996 |
| JP | 10-175338 | A | 6/1998 |

OTHER PUBLICATIONS

English language translation of Japanese Office Action issued Apr. 2, 2013, in connection with Japanese Patent Application No. 2009-179873.

* cited by examiner

*Primary Examiner* — Stephen Meier
*Assistant Examiner* — Alexander C Witkowski
(74) *Attorney, Agent, or Firm* — Birch, Stewart, Kolasch & Birch, LLP

(57) ABSTRACT

A medium holding apparatus includes: a medium holding conveyance device which has a plurality of suction grooves for suctioning a sheet-shaped medium, and conveys the medium in a prescribed direction while holding the medium on a medium holding surface; and a suction pressure generating device which is connected to the plurality of suction grooves, and generates suction pressure in each of the suction grooves, wherein: the plurality of suction grooves include a leading end suction groove provided at a position where a leading end region of the medium is held, and the leading end suction groove has a structure so as to be separated from other suction grooves of the plurality of suction grooves, and is connected to the suction pressure generating device via a flow channel which is not connected to the other suction grooves.

19 Claims, 23 Drawing Sheets

MEDIUM HOLDING APPARATUS AND IMAGE FORMING APPARATUS

BACKGROUND OF THE INVENTION

1. Field of the Invention

The present invention relates to a medium holding apparatus and an image forming apparatus, and more particularly to a medium holding apparatus suitable for holding and conveying paper in an image forming apparatus such as an inkjet recording apparatus, and an image forming apparatus in which such a medium holding apparatus is employed.

2. Description of the Related Art

As a general image forming apparatus, there is an inkjet recording apparatus, which forms a desired image on a recording medium by ejecting and depositing a plurality of colors of inks onto the recording medium from a plurality of nozzles provided in an inkjet head. The recording media used in the inkjet recording apparatus are not just paper media, but also include media of a plurality of types, such as resin sheet, metal sheet, and the like, and furthermore media of various sizes and thicknesses are used.

A conveyance member which holds and conveys the recording medium has a drum shape or belt shape, or the like. For the method of holding the recording medium, it is suitable to use an air suction method which holds the recording medium by applying a suction pressure (negative pressure) to the recording medium from inside the conveyance member through suction apertures arranged in the surface of the conveyance member.

In the air suction method described above, if the suction pressure is insufficient, then there is a possibility of positional displacement of the recording medium, and if the suction pressure is excessive, then there is a possibility of deformation of the recording medium, or the occurrence of image abnormalities caused by the ink droplets which have been deposited on the recording medium being sucked into the recording medium due to the suction pressure, or the like. Furthermore, if a plurality of suction apertures are provided in accordance with the maximum size so as to achieve compatibility with a plurality of media sizes, and the plurality of suction apertures are suctioned by a common pump, then if there are open suction apertures in cases where a recording medium of small size is used, air might leak through the open suction apertures giving rise to defective holding of the recording medium due to insufficient suction pressure. Consequently, various ways have been devised in order to avoid problems of these kinds.

In general, in order to form images of high definition, it is necessary for the inkjet head and the recording medium to be situated in closest possible proximity during image formation. However, if the recording medium makes contact with the inkjet head due to the inkjet head and the recording medium being situated in close proximity, then not only does the recording medium become soiled, but the inkjet head may also be damaged. Therefore, in order to prevent contact between the recording medium and the inkjet head, an extremely small working distance of several mm or less is provided between the inkjet head and the recording medium.

If folding or floating up of the recording medium occurs, then the recording medium may make contact with the inkjet head. In particular, in cases of using a recording medium based on a stiff material or a thick recording medium, or if a recording medium is conveyed at high speed, folding or floating up of the end portions of the recording medium in the direction of travel become liable to occur.

In order to prevent folding or floating of the recording medium of this kind, a method has been proposed in which the leading end portion of the recording medium is gripped and held.

FIG. 21 is a diagram showing a schematic view of a method of holding a recording medium by gripping the leading end region 514A of a recording medium 514 by means of a gripping mechanism (gripper) 580, in a rotational conveyance system using a conveyance drum 500. The holding method of the recording medium 514 shown in FIG. 21 reliably prevents folding of the leading end region 514A of a recording medium 514. Japanese Patent Application Publication No. 10-175338 discloses an inkjet printer, wherein a drum which holds a print medium has a structure in which a plurality of suction apertures connecting between the interior and exterior of the outer circumferential surface are provided and a porous sheet having a plurality of air flow apertures much smaller than the suction apertures is installed on the outer circumferential surface of the drum, whereby positional displacement of the print medium during rotation is prevented and the occurrence of density differences and bleeding of the ink on the print medium is also prevented.

However, with an air suction method, it is difficult to achieve compatibility with various different recording medium sizes or recording media using various different materials. For example, if the suctioning region is set in accordance with a recording medium of a large size, and a recording medium of a small size is used, then air leaking occurs in the regions which are not covered by the recording medium, and the suction force declines greatly. On the other hand, if the suction region is set in accordance with a small size, and a recording medium of a large size is used, then the perimeter portions (outer edge portions) of the recording medium are not suctioned and this can give rise to floating up and folding of the medium.

Furthermore, if using a recording medium having a large thickness or using a recording medium employing a material of high stiffness, such as resin, the leading end portion of the recording medium is liable to float up and if the suction pressure is raised in order to prevent this, then the pump, and the like, used to generate the suction pressure become large in size.

Moreover, although the method of gripping the leading end region 514A of the recording medium 514 shown in FIG. 21 is able effectively to prevent folding of the leading end region 514A of the recording medium 514, when the leading end region 514A of the recording medium 514 is introduced into the gripping mechanism 580, floating up of the medium occurs due to the difference in curvature between the recess section 522 where the gripping mechanism 580 is provided and the recording medium holding surface 502 (this floating is indicated by reference numeral 504 in FIG. 21).

SUMMARY OF THE INVENTION

The present invention has been contrived in view of these circumstances, an object thereof being to provide a medium holding apparatus, and an image forming apparatus employing such a medium holding apparatus, whereby recording media of various types and sizes can be held securely and folding or floating up of the recording medium can be suppressed effectively.

In order to attain an object described above, one aspect of the present invention is directed to a medium holding apparatus, comprising: a medium holding conveyance device which has a plurality of suction grooves for suctioning a sheet-shaped medium, and conveys the medium in a prescribed direction while holding the medium on a medium holding surface; and a suction pressure generating device which is connected to the plurality of suction grooves, and generates suction pressure in each of the suction grooves, wherein: the plurality of suction grooves include a leading end suction groove provided at a position where a leading end region of the medium is held, and the leading end suction groove has a structure so as to be separated from other suction grooves of the plurality of suction grooves, and is connected to the suction pressure generating device via a flow channel which is not connected to the other suction grooves.

Another aspect of the present invention is directed to an image forming apparatus, comprising: the medium holding apparatus, and a recording head for recording an image on the medium.

According to the present invention, in a medium holding apparatus comprising a plurality of suction grooves which suction a medium, since a leading end suction groove which suctions the leading end region of the medium is provided, and the leading end suction groove is separate from the other suction grooves and is connected to a suction pressure generating device via a flow channel which is not connected to the other suction grooves, then it is possible to hold the leading end region of the medium more reliably, without being affected by variations in the suction pressure in the other suction grooves.

DESCRIPTION OF THE PREFERRED EMBODIMENTS

General Composition of Inkjet Recording Apparatus

Figure 1:
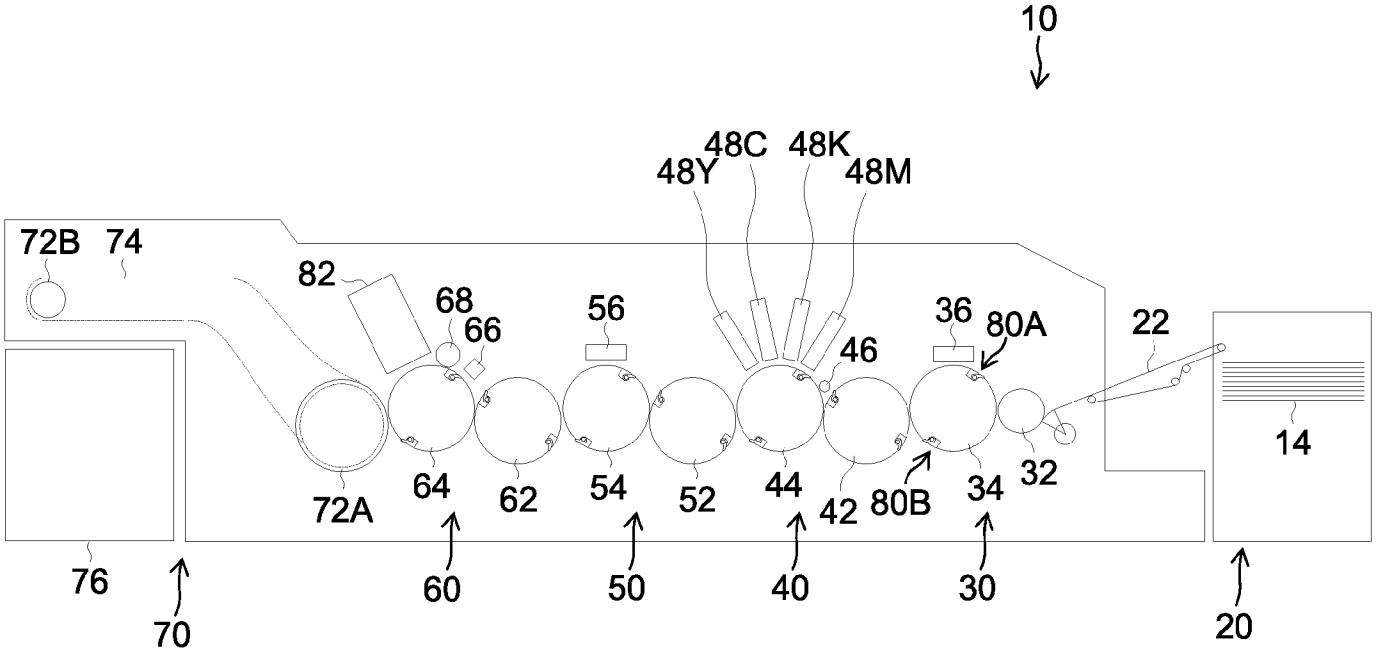
FIG. 1 is a general schematic drawing of an inkjet recording apparatus relating to an embodiment of the present invention.

FIG. 1 is a schematic drawing showing the general composition of an inkjet recording apparatus relating to the present embodiment. The inkjet recording apparatus 10 shown in FIG. 1 is a recording apparatus based on a two-liquid aggregation system which forms an image on a recording surface of a recording medium 14 on the basis of prescribed image data, by using ink containing coloring material and an aggregating treatment liquid having a function of aggregating the ink The inkjet recording apparatus 10 principally comprises a paper feed unit 20, a treatment liquid application unit 30, an image formation unit 40, a drying process unit 50, a fixing process unit 60 and an output unit 70. Transfer drums 32, 42, 52, 62, are provided as devices which receive and transfer a recording medium 14 conveyed respectively from stages prior to the treatment liquid application unit 30, the image formation unit 40, the drying process unit 50, and the fixing process unit 60, and furthermore, pressure drums 34, 44, 54, 64 having a drum shape are provided as devices for holding and conveying the recording medium 14 respectively in the treatment liquid application unit 30, the image formation unit 40, the drying process unit 50 and the fixing process unit 60.

Grippers 80A and 80B which grip and hold the leading end portion (or the trailing end portion) of the recording medium 14 are provided on the transfer drums 32 to 62 and the pressure drums 34 to 64. The gripper 80A and the gripper 80B adopt a common structure for gripping and holding the leading end portion of the recording medium 14 and for transferring the recording medium 14 with respect to a gripper provided in another pressure drum or transfer drum; furthermore, the gripper 80A and the gripper 80B are disposed in symmetrical positions separated by 180° in the direction of rotation of the pressure drum 34 on the outer circumferential surface of the pressure drum 34.

When the transfer drums 32 to 62 and the pressure drums 34 to 64 which have gripped the leading end portion of a recording medium 14 by means of the grippers 80A and 80B rotate in a prescribed rotation, the recording medium 14 is rotated and conveyed following the outer circumferential surface of the transfer drums 32 to 62 and the pressure drums 34 to 64.

In FIG. 1, only the reference numerals of the grippers 80A and 80B provided on the pressure drum 34 are indicated, and the reference numerals of the grippers on the other pressure drums and transfer drums are not shown.

When a recording medium (cut sheet paper) 14 accommodated in the paper feed unit 20 is supplied to the treatment liquid application unit 30, an aggregating treatment liquid (hereinafter, simply referred to as "treatment liquid") is applied to the recording surface of the recording medium 14 held on the outer circumferential surface of the pressure drum 34. The "recording surface of the recording medium 14" is the outer surface when the medium is held by the pressure drums 34 to 64, this being the surface opposite to the surface held on the pressure drums 34 to 64.

Thereupon, the recording medium 14 on which aggregating treatment liquid has been deposited is output to the image formation unit 40 and colored ink is deposited by the image formation unit 40 onto the area of the recording surface where the aggregating treatment liquid has been deposited, thereby forming a desired image.

Moreover, a recording medium 14 on which an image has been formed by the colored inks is sent to the drying process unit 50, and a drying process is carried out by the drying process unit 50, in addition to which the medium is conveyed to the fixing process unit 60 after the drying process and a fixing process is carried out. By carrying out a drying process and a fixing process, the image formed on the recording medium 14 is made durable. In this way, a desired image is formed on the recording surface of the recording medium 14 and after fixing the image on the recording surface of the recording medium 14, the medium is conveyed to the exterior of the apparatus from the output unit 70.

The respective units of the inkjet recording apparatus 10 (paper feed unit 20, treatment liquid application unit 30, image formation unit 40, drying process unit 50, fixing process unit 60 and output unit 70) are described in detail below.

Paper Feed Unit

The paper feed unit 20 comprises a paper feed tray 22 and a paying out mechanism (not illustrated) and is composed so as to pay out the recording medium 14 one sheet at a time from the paper feed tray 22. The recording medium 14 paid out from the paper feed tray 22 is registered in position by a guide member (not illustrated) and halted temporarily in such a manner that the leading end portion is disposed at the position of the gripper (not illustrated) on the transfer drum (paper feed drum) 32.

Treatment Liquid Application Unit

The treatment liquid application unit 30 comprises a pressure drum (treatment liquid drum) 34 which holds, on the outer circumferential surface thereof, a recording medium 14 transferred from the paper feed drum 32 and conveys the recording medium 14 in the prescribed conveyance direction, and a treatment liquid application apparatus 36 which applies treatment liquid to the recording surface of a recording medium 14 held on the outer circumferential surface of the treatment liquid drum 34. When the treatment liquid drum 34 is rotated in the counter-clockwise direction in FIG. 1, the recording medium 14 is conveyed so as to rotate in the counter-clockwise direction following the outer circumferential surface of the treatment liquid drum 34.

The treatment liquid application apparatus 36 shown in FIG. 1 is provided at a position facing the outer circumferential surface (recording medium holding surface) of the treatment liquid drum 34. One example of the composition of the treatment liquid application apparatus 36 is a mode which comprises a treatment liquid vessel which stores treatment liquid, an uptake roller which is partially immersed in the treatment liquid in the treatment liquid vessel and which takes up the treatment liquid in the treatment liquid vessel, and an application roller (rubber roller) which moves the treatment liquid taken up by the uptake roller, onto the recording medium 14.

A desirable mode is one which comprises an application roller movement mechanism which moves the application roller in the upward and downward direction (the normal direction with respect to the outer circumferential surface of the treatment liquid drum 34), so as to be able to avoid collisions between the application roller and the grippers 80A and 80B.

The treatment liquid deposited on the recording medium 14 by the treatment liquid application apparatus 36 contains a coloring material aggregating agent which aggregates the coloring material (pigment) in the ink deposited by the image formation unit 40, and when the treatment liquid and the ink come into contact with each other on the recording medium 14, the separation of the coloring material and the solvent in the ink is promoted.

Desirably, the treatment liquid application unit 30 doses the amount of treatment liquid applied to the recording medium 14 while applying the treatment liquid, and desirably, the thickness of the film of treatment liquid on the recording medium 14 is sufficiently smaller than the diameter of the ink droplets which are ejected from the image formation unit 40.

Image Formation Unit

The image formation unit 40 comprises a pressure drum (image formation drum) 44 which holds and conveys a recording medium 14, a paper pressing roller 46 for causing the recording medium 14 to adhere tightly to the image formation drum 44, and inkjet heads 48M, 48K, 48C and 48Y which deposit ink onto the recording medium 14. The basic structure of the image formation drum 44 is common to that of the treatment liquid drum 34 which is described previously, and therefore the description of it is omitted here.

The paper pressing roller 46 is a guide member for causing the recording medium 14 to make tight contact with the outer circumferential surface of the image formation drum 44, and is disposed facing the outer circumferential surface of the image formation drum 44, to the downstream side, in terms of the conveyance direction of the recording medium 14, of the transfer position of the recording medium 14 between the transfer drum 42 and the image formation drum 44 and to the upstream side, in terms of the conveyance direction of the recording medium 14, of the inkjet heads 48M, 48K, 48C and 48Y.

When the recording medium 14 which has been transferred from the transfer drum 42 to the image formation drum 44 is conveyed to rotate in a state where the leading end is held by a gripper (reference numeral not indicated), the recording medium 14 is pressed by the paper pressing roller 46 and is caused to make tight contact with the outer circumferential surface of the image formation drum 44. After the recording medium 14 has been caused to make tight contact with the outer circumferential surface of the image formation drum 44 in this way, the recording medium 14 is passed to a printing region directly below the inkjet heads 48M, 48K, 48C and 48Y, without any floating up of the medium from the outer circumferential surface of the image formation drum 44.

The inkjet heads 48M, 48K, 48C and 48Y respectively correspond to inks of the four colors of magenta (M), black (K), cyan (C) and yellow (Y), and are disposed in this order from the upstream side in terms of the direction of rotation of the image formation drum 44 (the counter-clockwise direction in FIG. 1), in addition to which the ink ejection surfaces of the inkjet heads 48M, 48K, 48C and 48Y (the nozzle surfaces, not shown in FIG. 1 and indicated by reference numeral 200A in FIG. 12) are disposed so as to face the recording surface of the recording medium 14 which is held on the image formation drum 44. Here, the "ink ejection surfaces (nozzle surfaces)" are surfaces of the inkjet heads 48M, 48K, 48C and 48Y which face the recording surface of the recording medium 14, and are the surfaces where the nozzles which eject ink as described below are formed (these nozzles are not shown in FIG. 1 and are indicated by reference numeral 202 in FIG. 12).

Furthermore, the inkjet heads 48M, 48K, 48C and 48Y shown in FIG. 1 are disposed at an inclination with respect to the horizontal plane in such a manner that the recording surface of the recording medium 14 which is held on the outer circumferential surface of the image formation drum 44 and the nozzle surfaces of the inkjet heads 48M, 48K, 48C and 48M are substantially parallel.

The inkjet heads 48M, 48K, 48C and 48Y are full line heads having a length corresponding to the maximum width of the image forming region on the recording medium 14 (the length of the recording medium 14 in the direction perpendicular to the conveyance direction), and are fixed so as to extend in a direction perpendicular to the conveyance direction of the recording medium 14.

Nozzles for ejecting ink are formed in a matrix configuration throughout the whole width of the image forming region of the recording medium 14 on the nozzle surfaces of the inkjet heads 48M, 48K, 48C and 48Y.

When the recording medium 14 is conveyed to a printing region directly below the inkjet heads 48M, 48K, 48C and 48Y, inks of respective colors are ejected (as droplets) on the basis of image data, from the inkjet heads 48M, 48K, 48C and 48Y onto the region of the recording medium 14 where an aggregating treatment liquid has been deposited.

When the droplets of the colored inks are ejected from the corresponding inkjet heads 48M, 48K, 48C and 48Y toward the recording surface of the recording medium 14 held on the outer circumferential surface of the image formation drum 44, the ink makes contact with the treatment liquid on the recording medium 14, and an aggregating reaction occurs with a coloring material (pigment-based coloring material) which is dispersed in the ink or a coloring material (dye-based coloring material) which can be insolubilized, thereby forming an aggregate of the coloring material. By this means, movement of the coloring material in the image formed on the recording medium 14 (namely, positional displacement of the dots, color non-uniformities of the dots) is prevented.

Furthermore, the image formation drum 44 of the image formation unit 40 is structurally separate from the treatment liquid drum 34 of the treatment liquid application unit 30, and therefore treatment liquid is never applied to the inkjet heads 48M, 48K, 48C and 48Y, and it is possible to reduce the causes of ink ejection abnormalities.

Although a configuration with the four standard colors of C, M, Y and K is described in the present embodiment, the combinations of the ink colors and the number of colors are not limited to these. Light and/or dark inks, and special color inks can be added as required. For example, a configuration is possible in which inkjet heads for ejecting light-colored inks, such as light cyan and light magenta, are added, and there is no particular restriction on the arrangement sequence of the heads of the respective colors.

Drying Process Unit

The drying process unit 50 comprises a pressure drum (drying drum) 54 which holds and conveys a recording medium 14 after image formation, and a drying process apparatus 56 which carries out a drying process for evaporating off the water content (liquid component) on the recording medium 14. The basic structure of the drying drum 54 is common with those of the treatment liquid drum 34 and the image formation drum 44 described previously, and therefore further description thereof is omitted here.

The drying process apparatus 56 is a processing unit which is disposed in a position facing the outer circumferential surface of the drying drum 54 and evaporates off the water content present on the recording medium 14. When ink is deposited on the recording medium 14 by the image formation unit 40, the liquid component (solvent component) of the ink and the liquid component (solvent component) of the treatment liquid which have been separated by the aggregating reaction between the treatment liquid and the ink remain on the recording medium 14, and therefore it is necessary to remove this liquid component.

The drying process apparatus 56 is a processing unit which carries out a drying process by evaporating off the liquid component present on the recording medium 14, through heating by a heater, or air blowing by a fan, or a combination of these, in order to remove the liquid component on the recording medium 14. The amount of heating and the air flow volume applied to the recording medium 14 are set appropriately in accordance with parameters, such as the amount of water remaining on the recording medium 14, the type of recording medium 14, the conveyance speed of the recording medium 14 (interference processing time), and the like.

When a drying process is carried out by the drying process unit 50, since the drying drum 54 of the drying process unit 50 is structurally separate from the image formation drum 44 of the image formation unit 40, then it is possible to reduce the causes of ink ejection abnormalities due to drying of the head meniscus portions in the inkjet heads 48M, 48K, 48C and 48Y as a result of the applied heat or air flow.

In order to display an effect in correcting cockling of the recording medium 14, the curvature of the drying drum 54 is desirably 0.002 (1/mm) or greater. Furthermore, in order to prevent curving (curling) of the recording medium after the drying process, the curvature of the drying drum 54 is desirably 0.0033 (1/mm) or less.

Moreover, desirably, a device for adjusting the surface temperature of the drying drum 54 (for example, an internal heater) may be provided to adjust the surface temperature to 50° C. or above. Drying is promoted by carrying out a heating process from the rear surface of the recording medium 14, thereby preventing destruction of the image in the subsequent fixing process. According to this mode, more beneficial effects are obtained if a device for causing the recording medium 14 to adhere tightly to the outer circumferential surface of the drying drum 54 is provided. Examples of a device for causing tight adherence of the recording medium 14 include a vacuum suctioning device, electrostatic attraction device or the like.

There are no particular restrictions on the upper limit of the surface temperature of the drying drum 54, but from the viewpoint of the safety of maintenance operations such as cleaning the ink adhering to the surface of the drying drum 54 (e.g. preventing burns due to high temperature), desirably, the surface temperature of the drying drum 76 is equal to or lower than 75° C. (and more desirably, equal to or lower than 60° C.).

By holding the recording medium 14 in such a manner that the recording surface thereof is facing outwards on the outer circumferential surface of the drying drum 54 having this composition (in other words, in a state where the recording surface of the recording medium 14 is curved in a projection shape), and carrying out a drying process while conveying the recording medium in rotation, it is possible reliably to prevent drying non-uniformities caused by wrinkling or floating up of the recording medium 14.

Fixing Process Unit

The fixing process unit 60 comprises a pressure drum (fixing drum) 64 which holds and conveys a recording medium 14, a heater 66 which carries out a heating process on the recording medium 14 which an image has been formed on and liquid has been removed from, and a fixing roller 68 which pressurizes the recording medium 14 from the recording surface side. The basic structure of the fixing drum 64 is common to that of the treatment liquid drum 34, the image formation drum 44 and the drying drum 54, and description thereof is omitted here. The heater 66 and the fixing roller 68 are disposed in positions facing the outer circumferential surface of the fixing drum 64, and are situated in this order from the upstream side in terms of the direction of rotation of the fixing drum 64 (the counter-clockwise direction in FIG. 1).

In the fixing process unit 60, a preliminary heating process by means of a heater 66 is carried out on the recording surface of the recording medium 14, and a fixing process by means of a fixing roller 68 is also carried out. The heating temperature of the heater 66 is set appropriately in accordance with the type of the recording medium, the type of ink (the type of polymer micro-particles contained in the ink), and the like. For example, a possible mode is one where the heating temperature is set to the glass transition temperature or the minimum film forming temperature of the polymer micro-particles contained in the ink.

The fixing roller 68 is a roller member for melting self-dispersing polymer micro-particles contained in the ink and thereby causing a state where the ink is covered by a film (a film is formed), by applying heat and pressure to the dried ink, and is composed so as to heat and pressurize the recording medium 14. More specifically, the fixing roller 68 is disposed so as to contact and press against the fixing drum 64, in such a manner that the fixing roller 68 serves as a nip roller with respect to the fixing drum 64. By this means, the recording medium 14 is sandwiched between the fixing roller 68 and the fixing drum 64 and is nipped with a prescribed nip pressure, whereby a fixing process is carried out.

An example of the composition of the fixing roller 68 is a mode where the roller is constituted by a heating roller which incorporates a halogen lamp inside a metal pipe made of aluminum, or the like, having good heat conductivity. If heat energy at or above the glass transition temperature of the polymer micro-particles contained in the ink is applied by heating the recording medium 14 by means of this heating roller, then the polymer micro-particles melt and a transparent film is formed on the surface of the image.

By applying pressure to the recording surface of the recording medium 14 in this state, the polymer micro-particles which have melted are pressed and fixed into the undulations in the recording medium 14, and the undulations in the image surface are thereby leveled out, thus making it possible to obtain a desirable luster. A desirable composition is one where fixing rollers 68 are provided in a plurality of stages, in accordance with the thickness of the image layer and the glass transition temperature characteristics of the polymer micro-particles.

Furthermore, desirably, the surface hardness of the fixing roller 68 is equal to or lower than 71°. By further softening the surface of the fixing roller 68, it is possible to expect effects in following the undulations of the recording medium 14 which are produced by cockling, and fixing non-uniformities caused by the undulations of the recording medium 14 are prevented more effectively.

The inkjet recording apparatus 10 shown in FIG. 1 comprises an in-line sensor 82 which is provided at a later stage of the processing region of the fixing process unit 60 (on the downstream side in terms of the direction of conveyance of the recording medium). The in-line sensor 82 is a sensor for reading the image formed on the recording medium 14 (or a test pattern (check pattern) formed in the margin area of the recording medium 14), and desirably employs a CCD line sensor.

In the inkjet recording apparatus 10 shown in the present embodiment, the presence and absence of ejection abnormalities in the inkjet heads 48M, 48K, 48C and 48Y are judged on the basis of the reading results of the in-line sensor 82. Furthermore, the in-line sensor 82 may include measurement devices for measuring the water content, surface temperature, luster (gloss level), and the like. According to this mode, parameters, such as the processing temperature of the drying process unit 50 and the heating temperature and applied pressure of the fixing process unit 60, are adjusted appropriately on the basis of the water content, surface temperature and the read result for the luster, and thereby the above control parameters are properly controlled in accordance with the temperature alteration inside the apparatus and the temperature alteration of the respective parts.

Output Unit

As shown in FIG. 1, an output unit 70 is provided subsequently to the fixing process unit 60. The output unit 70 comprises an endless conveyance belt 74 wrapped about tensioning rollers 72A and 72B, and an output tray 76 in which a recording medium 14 after image formation is accommodated.

The recording medium 14 which has undergone the fixing process and which is output from the fixing process unit 60 is conveyed by the conveyance belt 74 and output to the output tray 76.

Description of Medium Holding Device for Holding and Conveying Medium

Next, the structure of the pressure drums 34, 44, 54, 64, which convey the recording medium 14 in the prescribed direction while holding the recording medium 14, will be described in detail. Since the pressure drums 34, 44, 54, 64 have a common structure for holding the recording medium 14, then a conveyance drum (corresponding to "a medium holding device") 100 is described below as a general representation of the pressure drums 34, 44, 54, 64.

Figure 2:
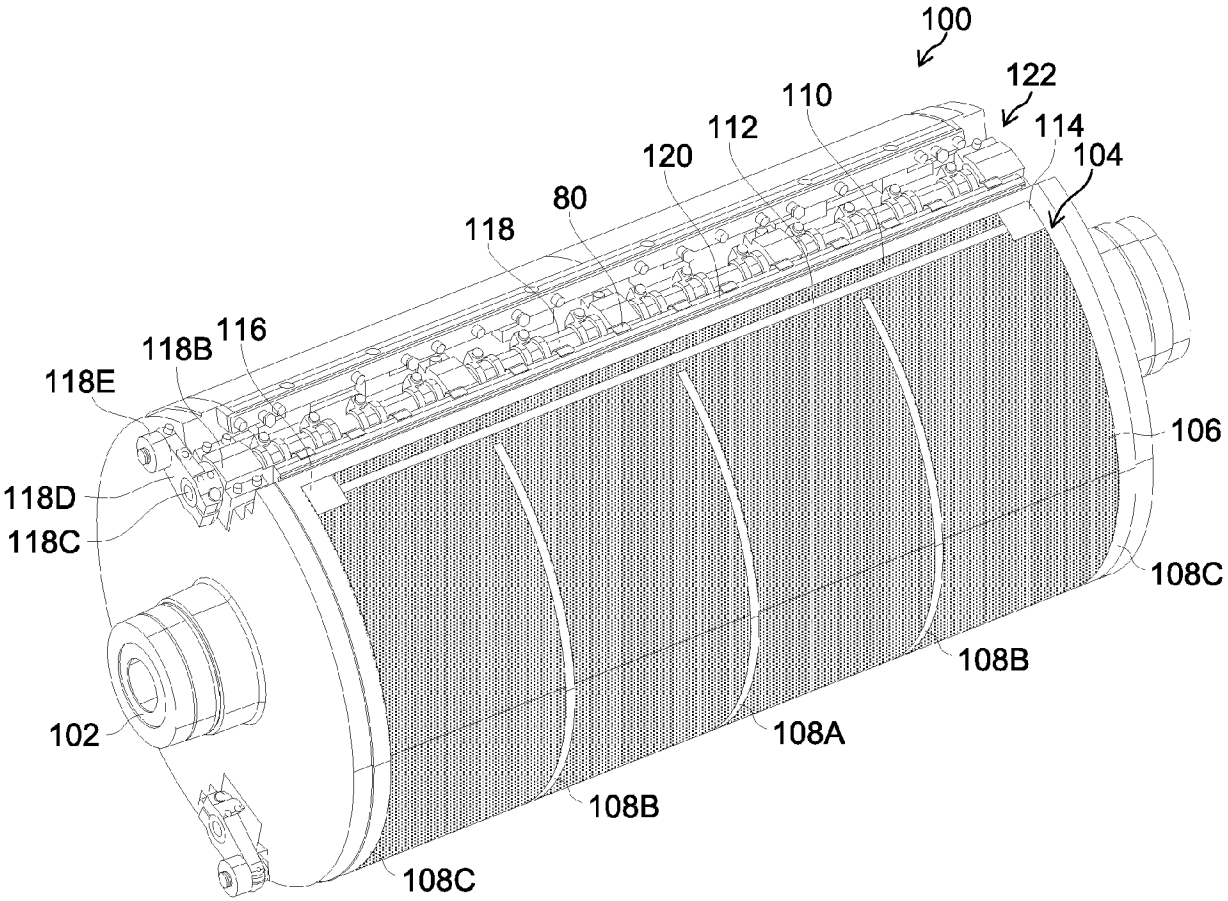
FIG. 2 is a perspective diagram showing the general structure of a conveyance drum.

FIG. 2 is a perspective diagram showing the overall structure of the conveyance drum 100. As shown in FIG. 2, the conveyance drum 100 is a rotating member which is coupled to a rotation mechanism (not shown) and is composed so as to be rotatable about a rotating axle 102 supported on bearings (not illustrated), due to the operation of the rotation mechanism.

Medium suction regions 106 (dot-hatched regions in FIG. 2) are provided on a medium holding surface (circumferential surface) 104 of the conveyance drum 100 on which the recording medium 14 (see FIG. 1) is held (secured), and a plurality of suction apertures (openings) are provided in the medium suction regions 106. For the sake of convenience, FIG. 2 does not depict the respective suction apertures in the medium suction regions 106, but in FIGS. 9A and 9B the suction apertures are denoted with reference numeral 190.

On the other hand, in FIG. 2, closed portions 108A to 108C where no suction apertures are disposed are provided in a band shape of uniform width following the circumferential direction of the conveyance drum 100, in the approximate central portion (108A) of the conveyance drum 100 in the axial direction thereof (the direction parallel to the rotating axle 102, hereinafter referred to as the "drum axial direction"), at positions (108B) approximately ¼ of the drum length to the left and right from the center of the conveyance drum 100, and also at the left-hand and right-hand end portions (108C) of the conveyance drum 100.

These closed portions 108A to 108C correspond to the positions of the drum suction grooves 132 formed in the drum main body 136, which are described hereinafter (see FIG. 4), and are provided so as to close off the rear sides of restrictor sections (154, 158, 178) of the suction grooves (152, 156, 166) which are formed in the rear surface of the suction sheet 130 (see FIGS. 7 to 8). Below, where necessary, the closed portions 108A to 108C may be denoted with the reference numeral 108.

The region depicted by a different hatching pattern in the medium suction regions 106 in FIG. 2 is a leading end region holding section 110 which holds the leading end region of the recording medium 14. The leading end region holding section 110 is provided through a length corresponding to the whole length of the axial direction of the conveyance drum 100, and has a prescribed length in the drum circumferential direction which corresponds to the portion where floating up of the leading end region of the recording medium 14 is liable to occur (for example, within 50 mm from the leading end of the recording medium 14).

A closed portion 112 following the drum axial direction is provided in the leading end region holding section 110, through a length corresponding to the full width of the compatible recording medium 14 (the total length in the direction substantially perpendicular to the conveyance direction of the recording medium 14). Drum suction grooves (indicated by reference numerals 132 and 134 in FIGS. 4 and 5) are provided in the drum main body in positions corresponding to the position of the closed portion 112.

The portions indicated by the dotted lines and labelled with the reference numerals 114 and 116 at either end in the drum axial direction are dummy half etched portions. The dummy half etched portions 114 and 116 are portions where a recess section that does not pass through the suction sheet is formed in the surface opposite to the medium holding surface 104 of the suction sheet (see FIGS. 7 and 8), and these portions are provided in order to maintain uniform rigidity of the whole suction sheet. The dummy half etched portions 114 and 116 correspond to portions where a recording medium 14 is not held in the drum axial direction.

A vacuum flow channel for suction which connects to the suction apertures of the medium suction regions 106 is provided inside the conveyance drum 100 shown in FIG. 2, and this vacuum flow channel is connected to a vacuum pump (not shown in FIG. 2, and depicted as a suction pressure generating device denoted with reference numeral 272 in FIG. 17) provided to the exterior of the conveyance drum 100, through a vacuum piping system (not illustrated) (including tubes, joints, and the like) provided on the side face of the conveyance drum 100, and through a vacuum flow channel (not illustrated) provided inside the rotating axle 102 of the conveyance drum 100. When a vacuum (negative pressure) is generated by operating the vacuum pump, a suction pressure is applied to the recording medium 14 through the suction apertures, the vacuum flow channel, and the like. In other words, the conveyance drum 100 is composed in such a manner that the recording medium 14 is held on the circumferential surface which forms the medium holding surface 104, by means of the air suction system.

A gripper 80 which grips the leading end of the recording medium 14 is provided on the conveyance drum 100, (FIG. 2 shows only one of the grippers 80A and 80B depicted in FIG. 1, and does not depict the other gripper). FIG. 2 shows a composition where a plurality of grippers 80 having an L shape are disposed at equidistant intervals in the drum axial direction, and are provided through a length corresponding to the full width of the compatible recording medium 14. The number of grippers 80 provided and the interval between same are determined in accordance with the full width of the compatible recording medium 14.

Figure 3:
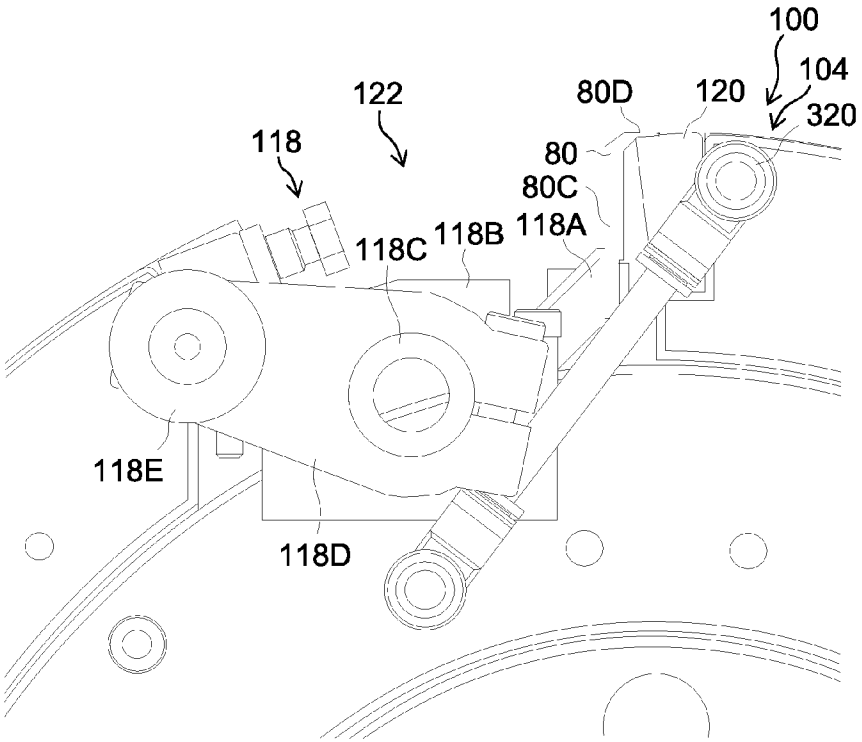
FIG. 3 is an enlarged diagram of a leading end gripping mechanism.

FIG. 3 is a diagram showing an enlarged side face view of a recess section 122 in which a gripper 80 is provided. The direction passing through the plane of the drawing in FIG. 3 is the drum axial direction of the conveyance drum 100.

As shown in FIG. 3, the gripper 80 has a straight section 80C and a hook section 80D, and is composed so as to be able to perform an opening and closing operation in accordance with the operation of an opening and closing mechanism 118. The gripper 80, the opening and closing mechanism 118, and a hook base 120 which grips the leading end of the recording medium 14 against the gripper 80 are provided inside a recess section 122 formed in the drum main body so as not to project from the medium holding surface 104 and come into contact with the inkjet heads 48M, 48K, 48C and 48Y (not shown in FIG. 3; see FIG. 1).

The gripper 80 holds the leading end of the recording medium by means of the hook portion 80D. The straight section (perpendicular portion) 80C of the gripper 80 is supported by the gripper base 118A, and furthermore, the gripper base 118A is connected to an opening and closing shaft 118C which is supported rotatably on a shaft bracket 118B. The opening and closing shaft 118C is coupled to a cam follower 118E via an opening and closing arm 118D.

The gripper 80 is constituted so as to make contact with and separate from an end holding surface of the hook base 120 (to perform an opening and closing operation), in accordance with the driving of a cam which is not illustrated, by means of a transmission mechanism having the composition described above.

Figure 4:
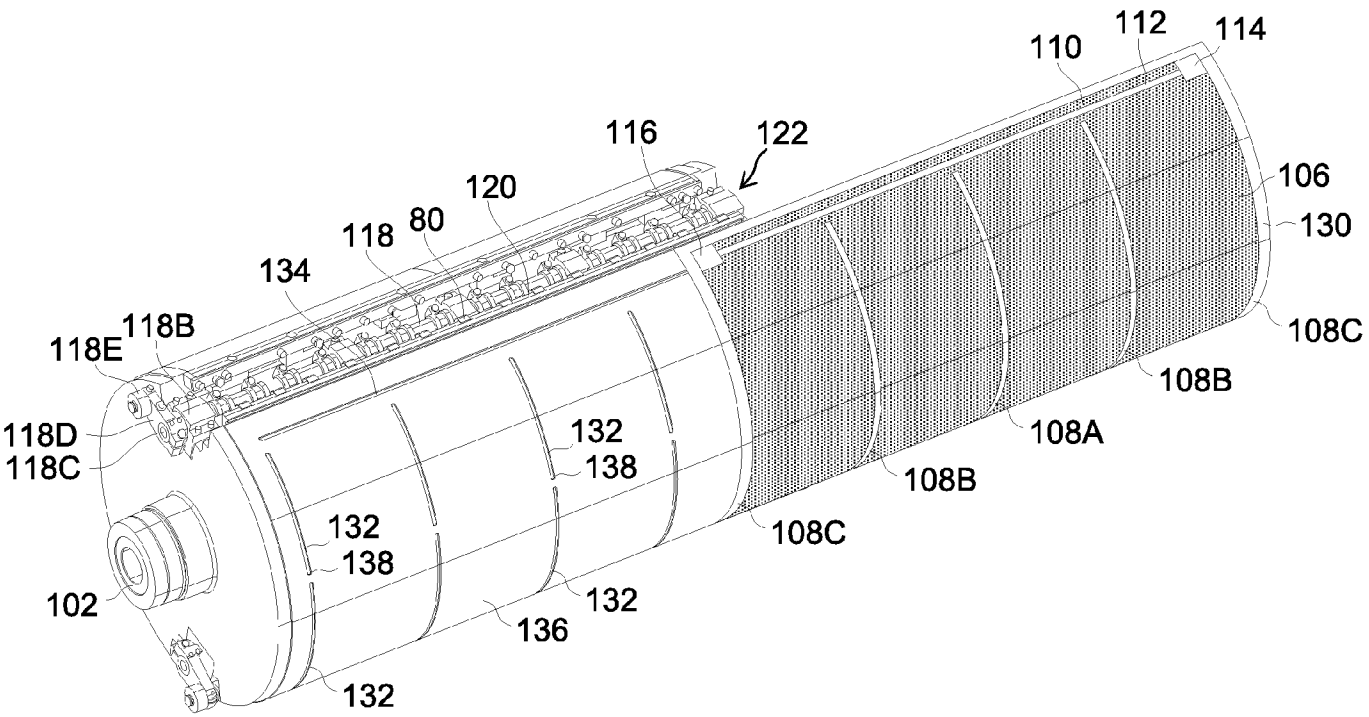
FIG. 4 is an exploded perspective diagram showing the internal structure of the conveyance drum shown in FIG. 2.

FIG. 4 is an exploded perspective diagram showing the structure of a conveyance drum 100. The conveyance drum 100 comprises: a suction sheet 130 having a lot of suction apertures formed in the surface thereof, and a drum main body 136 that includes drum suction grooves 132 which are connected to suction grooves (not shown in FIG. 4 and indicated by reference numerals 152, 156 and 166 in FIG. 7) formed on the rear surface of the suction sheet 130 via restrictor sections (not shown in FIG. 4 and indicated by reference numerals 154, 158 and 178 in FIG. 7), and a leading end drum groove 134 connected via restrictor sections to leading end suction grooves (not shown in FIG. 4; in FIG. 7, a first leading end suction groove indicated by reference numeral 152 and a second leading end suction groove indicated by reference numeral 156) which serve to hold the leading end region of the recording medium 14 (not shown in FIG. 4, see FIG. 1). Drum suction apertures 138 which are connected to a vacuum flow channel (not illustrated) provided inside the drum main body 136 are disposed in the end portions of the drum suction grooves 132 which are provided on the circumferential surface of the drum main body 136.

Structure of Drum Main Body

Figure 5:
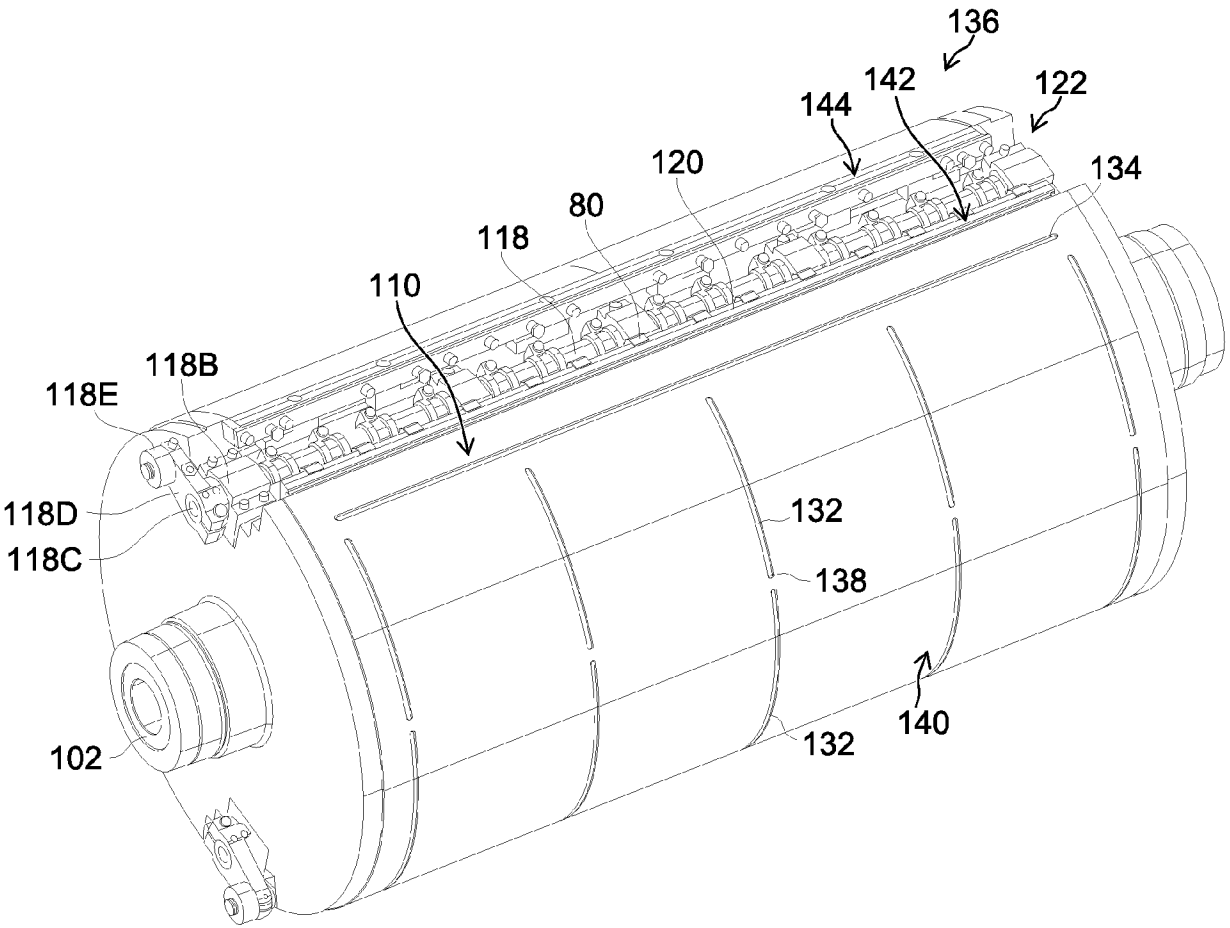
FIG. 5 is a perspective diagram showing the structure of a drum main body.

Next, the structure of the drum main body 136 will be described in detail. FIG. 5 is a perspective diagram showing the overall structure of the drum main body 136.

A plurality of drum suction grooves 132 are provided on the circumferential surface 140 of the drum main body 136, following a direction perpendicular to the drum axial direction (in the circumferential direction of the drum, in other words, the conveyance direction of recording medium 14), so as to correspond to the full circumference of the drum main body 136. Furthermore, a leading end drum groove 134 which connects to the leading end suction grooves provided in the leading end region holding section 110 that suctions the leading end region of the recording medium, is provided so as to correspond to the leading end region holding section 110. The leading end drum groove 134 has a separate structure from the other drum suction grooves 132, and furthermore is connected to a vacuum pump which is not shown in FIG. 5 (indicated by reference numeral 270 in FIG. 17) via a vacuum flow channel which is separate from the vacuum flow channel connected to the other drum suction grooves.

Figure 7:
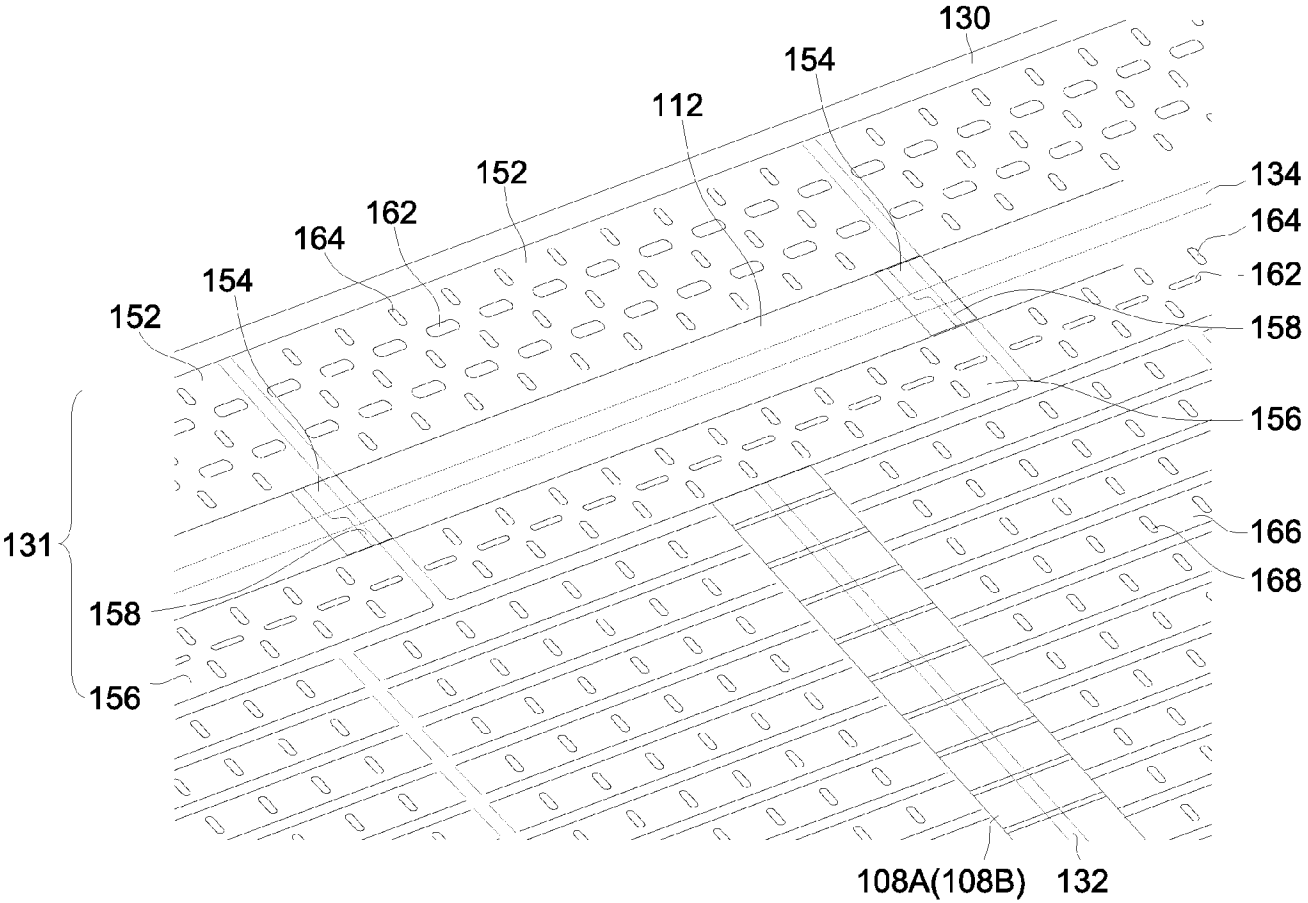
FIG. 7 is an enlarged diagram of a leading end suction section of a suction sheet.
Figure 8:
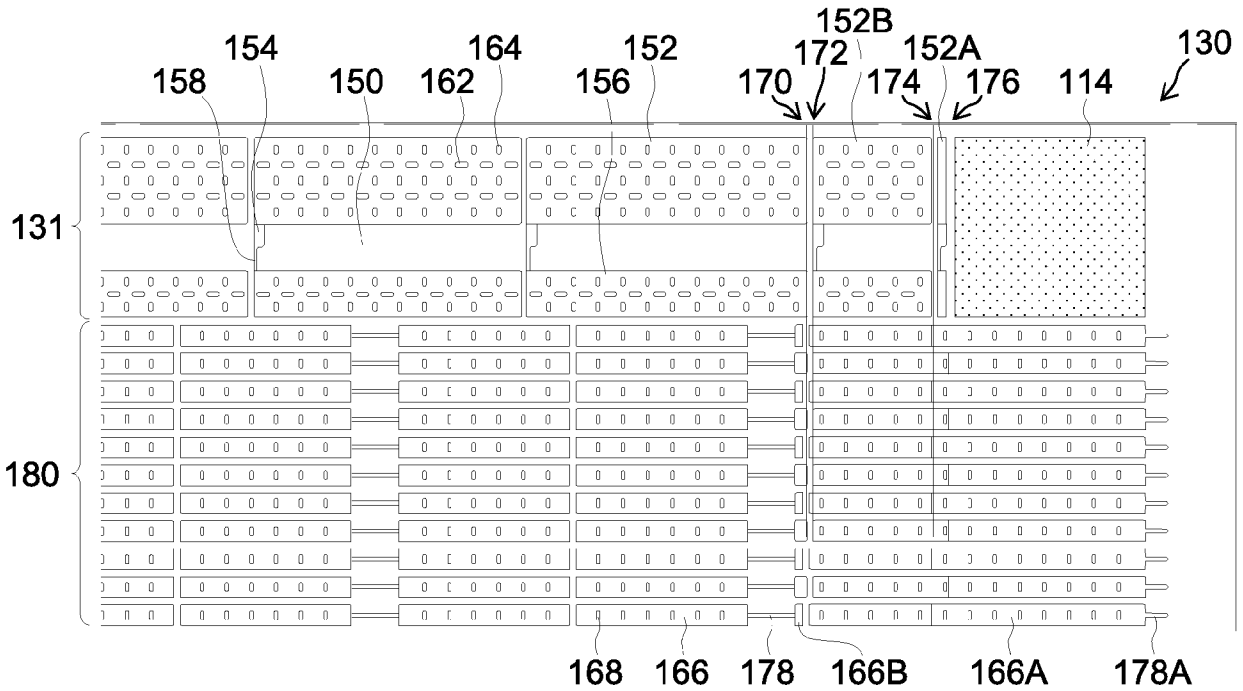
FIG. 8 is a plan diagram showing the structure of the rear surface of the suction sheet.

In other words, the leading end drum groove 134 is composed in such a manner that a suction pressure is applied from a dedicated vacuum pump via a dedicated vacuum flow channel, and therefore the suction grooves provided in the leading end region holding section 110 (the first leading end suction groove indicated by reference numeral 152 and the second leading end suction groove indicated by reference numeral 156 in FIGS. 7 and 8) are not affected by the suction grooves provided in the other portions of the drum (the suction grooves 166 shown in FIGS. 7 and 8), and even if there is large pressure loss in the other suction grooves, for example, a prescribed suction pressure is applied to the suction grooves which connect to the leading end drum groove 134.

Furthermore, as shown in FIG. 5, the drum main body 136 according to the present embodiment is divided into two parts in the drum circumferential direction. More specifically, in the drum main body 136, a recess section in which a mechanism for gripping the leading end of the recording medium 14, such as a gripper 80, is disposed is also provided on the opposite side of the drum from the recess section 122, and two recording medium suction holding regions having similar compositions are provided in the drum circumferential direction. Each of the divided regions has a similar structure, and here one of the divided regions will be described.

In the drum main body 136 shown in FIG. 5, the plurality of drum suction grooves 132 are provided respectively in different positions in the drum axial direction (five positions in the present embodiment: namely the center, respective ends and intermediate positions between the center and ends), in respect of each of the two divided regions which are divided in the drum circumferential direction. Two drum suction grooves 132 which are divided in two in the drum circumferential direction are provided in each of the five positions in the drum axial direction, and therefore a total of ten (10=5×2) drum suction grooves 132 are provided in one divided region. Since the similar composition is adopted through the whole circumference of the drum main body 136 and there are two divided regions, a total of twenty (20) drum suction grooves 132 are provided.

Each of the drum suction apertures 138 is provided at one end of each of the drum suction grooves 132, and the drum suction grooves 132 are connected through the drum suction apertures 138 to the vacuum flow channel (not shown) provided inside the drum main body 136. The vacuum flow channel is connected to a vacuum pump (not shown) through the vacuum piping system (not illustrated), which is provided on the side face of the drum main body 136, and the vacuum flow channel (not illustrated) provided inside the rotating axle 102.

The drum main body 136 is provided with a grooved structure (a gripping and holding section for holding the suction sheet) 142 and a tensioning mechanism 144 on the circumferential surface 140 of the drum main body 136. The grooved structure 142 grips a fold structure (L-shaped bend structure) provided on the suction sheet 130 when holding the suction sheet 130. The tensioning mechanism 144 is disposed on the opposite side of the drum main body 136 from the gripping and holding structure 142, and applies tension to the suction sheet 130 in the drum circumferential direction in a state where the fold structure (L-shaped structure) of the suction sheet 130 is gripped.

The gripping and holding structure 142 and the tensioning mechanism 144 of the drum main body 136 may have any structure which enables them to hold the suction sheet 130 shown in FIG. 2 in a state where the suction sheet 130 is in tight contact with the circumferential surface 140. The conveyance drum 100 in the present embodiment has the prescribed vacuum flow channels arranged about the full circumference of the conveyance drum 100 by arranging two suction sheets 130 aligned in the drum circumferential direction. In other words, two pairs of the gripping and holding sections 142 and the tensioning mechanisms 144 are provided in two mutually opposing positions in the drum circumferential direction.

Figure 6:
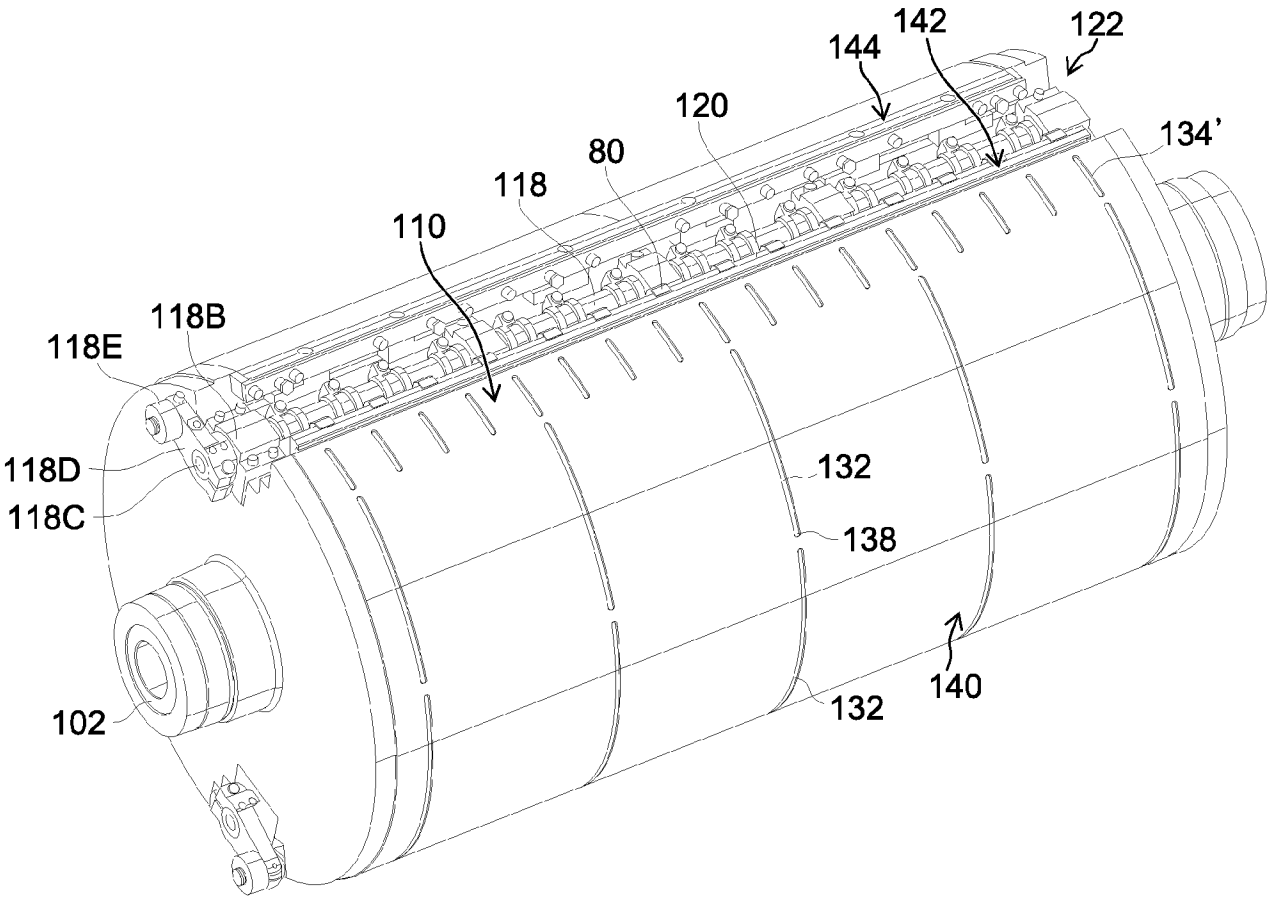
FIG. 6 is a perspective diagram showing a further example of the structure of the drum main body shown in FIG. 5.

FIG. 5 shows a mode where a leading end drum groove 134 following the drum axial direction is provided, but as shown in FIG. 6, it is also possible to adopt a mode where leading end drum grooves 134' following the drum circumferential direction are provided as shown in FIG. 6, or a mode where leading end drum grooves (not illustrated) following a direction of inclination which intersects with the drum axial direction (or drum circumferential direction) are provided.

More specifically, the leading end drum groove 134 (134') has a separate structure from the other drum suction grooves 132, and should be composed so as to receive a supply of suction pressure from a vacuum pump which is separate from the vacuum pump that supplies the suction pressure to the other drum suction grooves 132, by being connected to a vacuum flow channel which is not connected to the other drum suction grooves 132.

Composition of Suction Sheet

FIG. 7 is a partial enlarged diagram of a suction sheet 130, as viewed from the side of medium holding surface 104 (see FIG. 2). The diagonally upward left-hand side in FIG. 7 corresponds to the leading end side of the recording medium 14 (not shown in FIG. 7, see FIG. 1).

FIG. 7 shows an enlarged view of substantially the central portion of the leading end suction portion 131 of the suction sheet 130 (the portion corresponding to the leading end region holding section 110 of the conveyance drum 100 shown in FIG. 2). For the sake of convenience, the suction apertures which are provided in the medium holding surface of the suction sheet 130 are not depicted in FIG. 7 (but are indicated by reference numeral 190 in FIG. 9A), and the rear surface pattern is indicated by the broken lines.

A closed portion 112 in which suction apertures are not disposed is provided in the front surface of the suction sheet 130. The closed portion 112 which is provided following the direction corresponding to the drum axial direction of the conveyance drum 100 (see FIG. 2 to FIG. 4) (described as "drum axial direction" below, similarly to the conveyance drum) has a structure for closing off the upper sides of the leading end drum groove 134 (indicated by the dotted lines), the restrictor sections 154 which connect with the first leading end suction groove 152 and the restrictor sections 158 which connect with the second leading end suction groove 156.

Furthermore, the closed portion 108A (108B) provided following the direction corresponding to the drum circumferential direction (described as the "drum circumferential direction" below, similarly to the conveyance drum) is a structure for closing off the upper sides of the drum suction grooves 132 indicated by the dotted lines and the restrictor sections (not shown in FIG. 7 and indicated by reference numeral 178 in FIG. 8) which connect with the drum suction grooves 132.

The first leading end suction groove 152 and the second leading end suction groove 156 for suctioning the leading end region of the recording medium are provided in the leading end suction portion 131 of the suction sheet 130. The first leading end suction groove 152 is provided to the leading end side of the recording medium 14 (see FIG. 1) with respect to the leading end drum groove 134, and the second leading end suction groove 156 is provided toward the central side of the recording medium with respect to the leading end drum groove 134.

The first leading end suction groove 152 and the second leading end suction groove 156 are provided following the drum axial direction, and are divided into a plurality of regions in the drum axial direction. The divided regions are connected to the leading end drum groove 134 via individual restrictor sections 154 and 158 respectively.

Ribs 162 and 164 having a protruding shape are provided in the first leading end suction groove 152. The ribs 162 and 164 are formed in an island-shaped pattern, and the height thereof is substantially equal to the depth of the first leading end suction groove 152 and the second leading end suction groove 156. The ribs 162 are formed in a broken line configuration parallel to the drum axial direction. Furthermore, a plurality of rows (two rows in FIG. 7) of ribs 162 (rib rows) aligned in a broken line configuration following the drum axis direction are formed inside the first leading end suction groove 152. The distance between the rib rows is substantially equal to the groove width of the suction grooves 166 which suction the central portion of the recording medium.

Furthermore, the ribs 164 in a row are arranged separately from each other in a line perpendicular to the drum axial direction, in the interspace between the ribs 162 adjacent to each other in the drum axial direction. The lengthwise direction of each rib 164 is also perpendicular to the drum axial direction.

By providing respectively divided island-shaped ribs 162 and 164 in this way, it is possible to prevent indentations in the arched surface of the recording medium 14 held by suction on the suction sheet 130 and therefore a uniform throw distance can be maintained. Furthermore, since air is able to move through the gaps between the separated island-shaped ribs 162 and 164, then it is possible to ensure the flow volume of air in the first end suction grooves 152. In other words, it is possible to supply a greater flow volume from the other portions of the grooves, in response to leaks occurring at a particular position in a first end suction groove 152.

Supposing that the ribs 162 and 164 were not provided inside the grooves, then when the recording medium is held by suction, indentations would occur in the regions of the suction sheet 130 corresponding to the first end suction grooves 152. Furthermore, if the ribs 162 were joined together and formed in a single continuous line shape, then the interior space of the first end suction grooves 152 would be divided up and the grooves would effectively become equivalent to narrow-width flow channel grooves (the flow channel cross-sectional area of the first end suction grooves 152 becomes effectively smaller). Therefore, it would become impossible to ensure the required sucking flow volume.

From the viewpoint of preventing indentations of the recording medium as described above and to ensure the required flow volume, a desirable mode is one where the island-shaped ribs 162 and 164 are formed inside the grooves. The arrangement direction and configuration of the ribs are not limited in particular, and the ribs may also be arranged in a configuration arranged obliquely to the drum axial direction.

From a similar viewpoint to the foregoing, ribs 162 and 164 are also provided in the second leading end suction groove 156 and island-shaped ribs 168 are provided at suitable intervals in the drum circumferential direction in the suction grooves 166.

FIG. 8 is a diagram showing an end portion of the leading end suction portion 131 of the suction sheet 130 in the drum axial direction, viewed from the back side. In FIG. 8, parts which are the same as or similar to those in FIG. 7 are labelled with the same reference numerals and further explanation thereof is omitted here.

The thick solid lines labelled with the reference numerals 170, 172, 174 and 176 in FIG. 8 represent the end positions of the recording media used (the paper side end face) in terms of the width direction. The paper side end face 176 on the outermost side corresponds to the maximum width of the recording medium which can be used. The upper side in FIG. 8 is the leading end direction of the recording medium.

The lengths, in the drum axial direction, of the first leading end suction groove 152 and the second leading end suction groove 156 which are provided following the drum axial direction (left/right direction in FIG. 8) of the conveyance drum 100 (see FIG. 2 and FIG. 4) and are divided in the drum axial direction, are determined in accordance with the paper side end faces 170 to 176. For example, the first leading end suction groove 152 shown in FIG. 8 is divided into uniform lengths in the drum axial direction outside of the vicinity of the end portions, for instance, in substantially the central portion, but the length thereof in the drum axial direction is shorter in the vicinity of the end portions compared to the region other than the vicinity of the end portions. Furthermore, the length in the drum axial direction becomes progressively shorter toward the end portions.

According to the first leading end suction groove 152 which has a structure of this kind, even if using recording media having little width difference, such as a recording medium corresponding to the paper side end face 174 and a recording medium corresponding to the paper side end face 176, the paper side end faces (170 to 176) of the recording media used can be positioned over the first leading end suction groove 152, and a suction pressure can therefore be applied reliably to the end portions of the recording medium.

Moreover, since a restrictor section 154 is provided with respect to each of the divided regions of the first leading end suction groove 152 and the groove (each divided region) is connected to the leading end drum groove 134 via the restrictor sections 154, then it is possible to reduce the loss in suction pressure in the vicinity of the end portions, and to prevent floating up and folding of the recording medium due to insufficient suction pressure.

Furthermore, the restrictor sections 154 between the leading end drum groove 134 and the first leading end suction groove 152 which is disposed on the leading end side have a greater width (a greater length in the drum axial direction) than the restrictor sections 158 between the leading end drum groove 134 and the second leading end suction groove 156 which is disposed on the central side. More specifically, by making the flow channel resistance of the restrictor sections 154 of the first leading end suction groove 152 less than that of the restrictor sections 158 of the second leading end suction groove 156, it is possible to generate a greater suction force in the first leading end suction groove 152.

FIG. 8 shows a mode where the partition portions which separate the divided regions of the first leading end suction groove 152 have a uniform width (uniform length in the drum axial direction), but it is also possible to change the width of the partition portions appropriately, in such a manner that the paper side end faces are not positioned at a partition portion.

Furthermore, as shown in FIG. 8, a dummy half etching portion 114 is provided to the outer side of the maximum size of the recording medium in the leading end suction portion 131 where the first leading end suction groove 152 and the second leading end suction groove 156 are provided. The dummy half etching portion 114 is a portion where a half etching process has been carried out from the rear side or the front side, in such a manner that the rigidity of the suction sheet 130 remains uniform. One example of a half etching process is a mode where a plurality of recess sections having a depth of approximately one half of the thickness of the suction sheet 130 are formed in a pattern which is the same as or similar to that of the suction apertures (not shown in FIG. 8 and indicated by reference numeral 190 in FIG. 9A).

The end portion on the opposite side to the dummy half etching portion 114 shown in FIG. 8 has a similar structure, and a dummy half etching portion 116 shown in FIG. 2 is also provided therein. If the type of the recording medium used is restricted to a relatively small size (a size which does not use the respective both end portions in the drum axial direction), then the structure of the suction sheet 130 shown in FIG. 8 is employed.

In the general suction section 180 of the suction sheet 130 (the region apart from the leading end suction portion 131), suction grooves 166 are formed following the drum axial direction so as to be substantially perpendicular to the drum suction grooves 132 formed in the drum circumferential direction (not shown in FIG. 8; see FIG. 2). Furthermore, a plurality of suction grooves 166 having the same length (groove width) are arranged at uniform intervals in the drum circumferential direction.

In the general suction section 180, a structure is adopted in which two suction grooves 166, 166 which share a restrictor section 178 are disposed respectively to the left and right-hand sides of the restrictor section 178, and these two suction grooves 166, 166 aligned in the drum axial direction are connected via the common restrictor section 178.

Moreover, the suction grooves 166A in both the end portions in the drum axial direction have a greater length (groove length) in the drum axial direction than the suction grooves 166 in the other portions, and furthermore are connected to the drum suction grooves provided in the respective side end portions in the drum axial direction of the drum main body 136 (not shown in FIG. 8, see FIG. 2) via restrictor sections 178A provided on the outer side of the suction grooves 166A.

A suction groove 166B of shorter axial length than the other suction grooves 166 is provided adjacently to the inner side of each of the suction grooves 166A in these both end portions. These suction grooves 166B of short axial length are each connected to a drum suction groove via a restrictor section 178 which is shared with the adjacent suction groove 166 to the inner side. In the mode shown in FIG. 8, the axial length of the short suction groove 166B is determined in such a manner that the paper side end face 170 is disposed over this suction groove 166B having a short axial length, and therefore it is possible to reliably suction an end portion of the recording medium in the breadthways direction, which correspond to the paper side end face 170.

More specifically, the groove length of the suction grooves 166 corresponds to the width of the recording medium (the length in the direction perpendicular to the conveyance direction), and the groove width and arrangement interval of the suction grooves 166 correspond to the length of the recording medium in the conveyance direction.

In the mode shown in FIG. 8, the groove width of the first leading end suction groove 152 and the second leading end suction groove 156 is greater than the groove width of the suction grooves 166, 166A and 166B. The groove width of the first leading end suction groove 152 shown in FIG. 8 is approximately three times the groove width of the suction groove 166, and the groove width of the second leading end suction groove 156 is approximately twice the groove width of the suction groove 166.

Furthermore, the groove width of the restrictor sections 178 which connect with the suction grooves 166 is approximately ¼ the groove width of the suction grooves 166. Desirably, the groove width of the restrictor sections 178 is equal to or greater than 0.2 mm and equal to or less than 5.0 mm, and more desirably, equal to or greater than 1.0 mm and equal to or less than 3.0 mm Furthermore, it is desirable that the length of the restrictor sections 178 in the drum axial direction should be equal to or greater than 2.0 mm and equal to or less than 10.0 mm The shape and arrangement pattern of the suction grooves 166 shown in FIG. 8 are not limited to the present example, and the shape, length, groove direction, number of grooves and arrangement pattern can be designed in accordance with the size of the recording medium.

Structure of Flow Channels in Conveyance Drum

As described above, the conveyance drum 100 according to the present embodiment has a structure in which drum suction grooves 132 of the drum main body 136 and restrictor sections 178 on the rear surface of the suction sheet 130 are registered in position, the leading end drum groove 134 and the restrictor sections 154 and 158 are registered in position, and the suction sheet 130 is wrapped and fixed tightly to the circumferential surface of the drum main body 136.

Figure 9A:
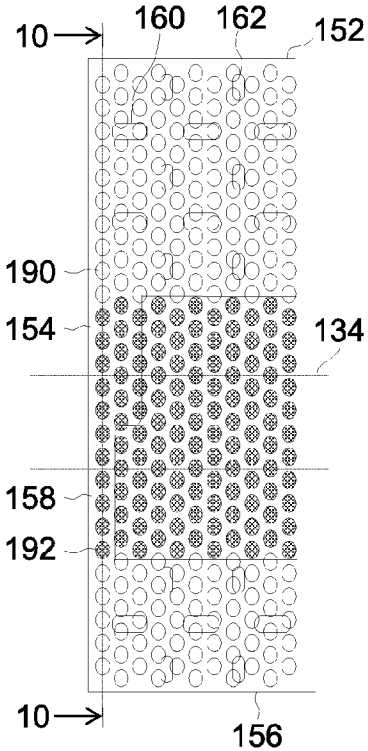
FIGS. 9A and 9B are plan view perspective diagrams showing the structure of a suction sheet.
Figure 9B:
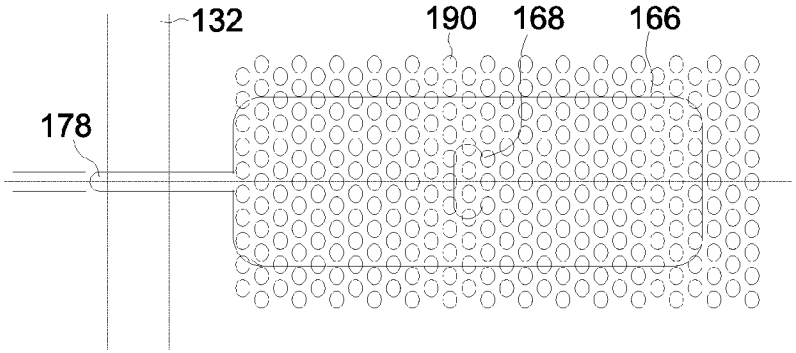

FIG. 9A shows the relative positions of the suction apertures 190 of the suction sheet 130, the first leading end suction groove 152, the second leading end suction groove 156 and the leading end drum groove 134, and FIG. 9B shows the relative positions of the suction apertures 190, the suction grooves 166 (166A, 166B) and the drum suction groove 132. Furthermore, FIG. 10 shows the structure of the suction sheet 130 shown in FIG. 9A (a cross-sectional diagram along line 10-10 in FIG. 9A).

As shown in FIGS. 9A and 9B, the arrangement pattern of the suction apertures 190 provided in the suction sheet 130 desirably corresponds to the pattern on the rear side of the first leading end suction groove 152, the second leading end suction groove 156 and the suction grooves 166, but there may be suction apertures 190 which are not connected to the first leading end suction groove 152, the second leading end suction groove 156 or the suction grooves 166.

As shown in FIG. 9A, a recess section 192 which is not connected to the restrictor sections 154 and 158 (indicated by the dot hatching) is provided above the restrictor sections 154 and 158 which are connected to the first leading end suction groove 152 and the second leading end suction groove 156. As shown in FIG. 9A, when the suction sheet 130 is observed from the recording medium suction holding surface, suction apertures 190 which are connected to the first leading end suction groove 152 and the second leading end suction groove 156 are provided in the portion where the first leading end suction groove 152 and the second leading end suction groove 156 are provided, and recess sections 192, which are closed holes, are provided in the portion where the restrictor sections 154 and 158 (closed portions 112, see FIG. 8) are provided.

Figure 10:
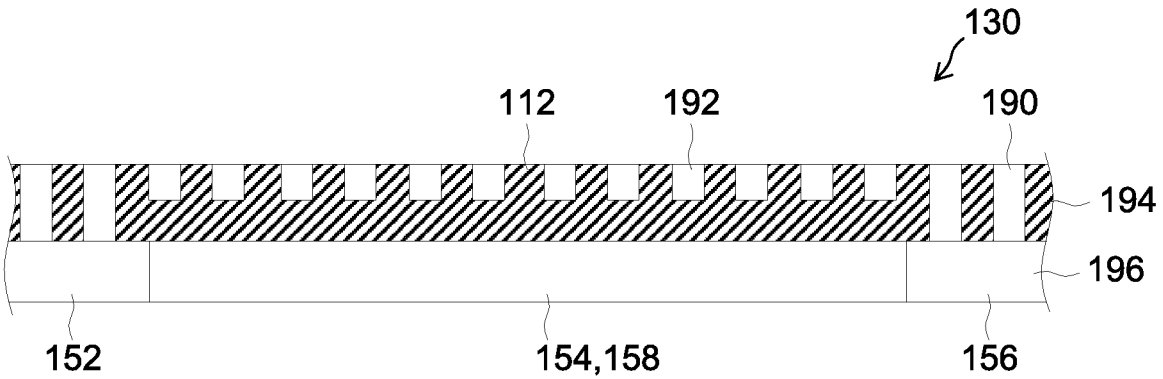
FIG. 10 is a cross-sectional diagram along line 10-10 in FIG. 9A.

As shown in FIG. 10, the recess sections 192 should have a form which does not pass through the suction aperture layer 194 in which the suction apertures 190 and recess sections 192 are provided and does not reach the flow channel groove forming layer 196 in which the first leading end suction groove 152, the second leading end suction groove 156 and the restrictor sections 154 and 158 are provided. The depth of the recess sections 192 shown in FIG. 10 is substantially one half of the thickness of the suction aperture layer 194.

By providing recess sections 192 of a shape and pattern which are the same as or similar to the suction apertures 190, in the closed portion 112 which closes off the upper side of the restrictor sections 154 and 158 and the leading end drum groove 134, the occurrence of temperature distribution on the surface which holds the recording medium is suppressed, and ink temperature variation and variation in the dots formed on the recording medium which is dependent on the temperature, can also be suppressed.

Furthermore, the width of the restrictor sections 154, 158 and 178 is narrower than the width of the first leading end suction groove 152, the second leading end suction groove 156 and the suction grooves 166, and furthermore, the restrictor sections 154, 158, 178, the first leading end suction groove 152, the second leading end suction groove 156 and the suction grooves 166 have substantially the same depth. Moreover, the flow channel cross-sectional area of the restrictor sections 154, 158 and 178 is smaller than the flow channel cross-sectional area of the first leading end suction groove 152, the second leading end suction groove 156 and the suction grooves 166, and furthermore, the flow volume of air passing through the first leading end suction groove 152, the second leading end suction groove 156 and the suction grooves 166 is restricted by the restrictor sections 154, 158 and 178.

As shown in FIG. 10, the thickness of the suction aperture layer 194 is greater than the thickness of the flow channel groove forming layer 196 on the rear surface side, and in the mode illustrated, the thickness of the flow channel groove forming layer 196 is substantially one half the thickness of the suction aperture layer 194.

The flow channel groove forming layer 196 is a portion having a prescribed thickness on the rear surface of the sheet where the first leading end suction groove 152, the second leading end suction groove 156 and suction grooves 166, and the pattern of ribs 162, 164, 168, and the like, described in relation to FIGS. 7 and 8, are formed. The smaller the thickness of the flow channel groove forming layer 196, the more possible it becomes to obtain a high suction force by means of a small negative pressure, but if the layer is excessively thin, then blockages caused by paper dust, dirt and other foreign matter become liable to occur. Taking conditions such as these into consideration, the thickness of the flow channel groove forming layer 196 is desirably, 0.05 mm to 0.5 mm, approximately.

The suction aperture forming layer 194 in the suction sheet 130 is required to have a thickness that ensures sufficient rigidity to avoid depression due to the suction pressure in the portions where the ribs 162, 164 and 168 are not present therebelow, and in order to wrap and hold the suction sheet 130 about the circumferential surface of the drum main body 136, corresponding flexibility is required. For instance, desirably, the thickness of the suction aperture forming layer 194 in a suction sheet 130 fabricated from stainless steel is 0.1 mm to 0.5 mm, more desirably 0.2 mm to 0.3 mm, approximately.

If a material other than stainless steel is used, then a suitable thickness should be determined by taking account of the rigidity and flexibility of the material used.

Description of the Suction Apertures

Figure 11A:
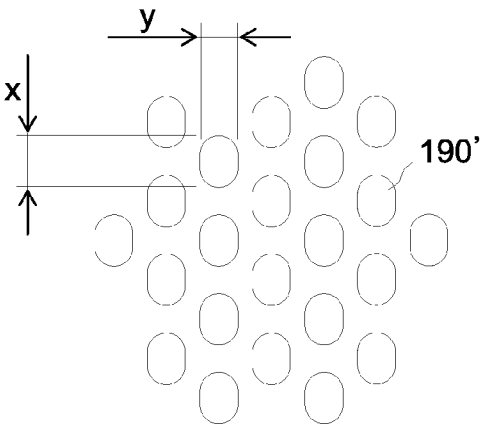
FIGS. 11A and 11B are diagrams showing examples of the composition of suction apertures formed in a suction sheet.
Figure 11B:
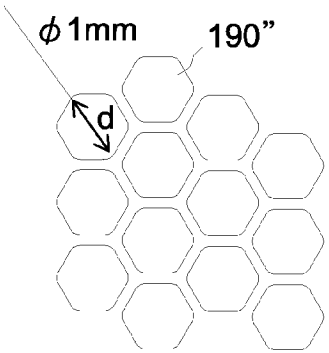

FIGS. 11A and 11B show examples of the composition of the shape and pattern of the suction apertures 190 shown in FIGS. 9A and 9B. The shape of the suction apertures 190 formed on the front surface of the suction sheet 130 (see FIGS. 7 and 8) may be substantially a circular shape as shown in FIGS. 9A and 9B, or an oval (elongated hole) shape as shown in FIG. 11A, or a hexagonal shape (polygonal shape) as shown in FIG. 11B.

In FIG. 11A, each suction aperture 190' is of an elongated oval shape having the major axis length x of 2 mm and the minor axis length y of 1.5 mm It is desirable that the ratio of "y/x" between the major axis length x and the minor axis length y of the suction apertures 190' having an elongated oval shape is not smaller than 0.5 and not larger than 1.0, and more desirably, not smaller than 0.7 and not larger than 0.9.

As shown in FIG. 11B, it is also desirable that the shape of the openings (the shape of suction apertures 190") is a polygonal shape, such as a hexagonal shape, in order to increase the opening ratio of the suction sheet 130. More specifically, since the suction force can be represented by "(opening surface area)×(pressure per unit surface area)", then by increasing the opening ratio, it is possible further to increase the suction force. However, if the opening surface area becomes too large, then depression of the suction sheet 130 and depression of the recording medium 14 become a problem, and therefore it is desirable to adopt a structure which leaves boundary portions between adjacent suction apertures 190", so as to guarantee the rigidity of the suction sheet 130.

Considering these conditions, a desirable shape for the suction apertures 190" is a hexagonal shape in which the length d of the diagonal (the longest diagonal) is approximately 1 mm. Moreover, if the suction apertures 190" have an angled (sharp angled) shape, then stress is concentrated in the corner sections, and therefore it is desirable that the corners should be given a rounded shape.

Structure of Inkjet Head

Next, the structure of the inkjet heads 48M, 48K, 48C and 48Y provided in the image formation unit 40 will be described. The inkjet heads 48M, 48K, 48C and 48Y corresponding to the respective colors have a common structure, and therefore these inkjet heads are represented by an inkjet head (hereinafter, simply called "head") indicated by the reference numeral 200 below.

Figure 12:
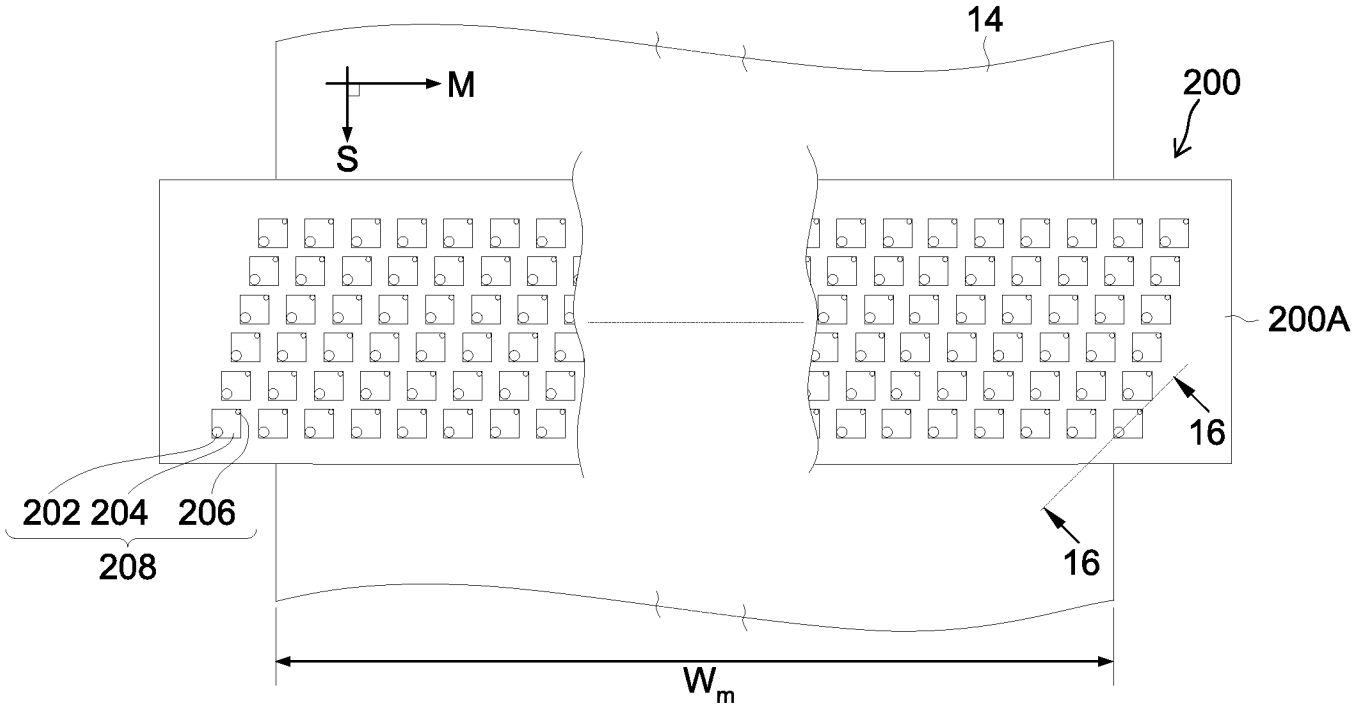
FIG. 12 is a plan view perspective diagram showing an example of the composition of an inkjet head.

FIG. 12 is a plan view perspective diagram showing an example of the structure of the head 200. In the present specification, parts which are the same as or similar to diagrams described previously are labelled with the same reference numerals and further explanation thereof is omitted here.

As shown in FIG. 12, the head is a full line type of head having a structure in which a plurality of nozzles 202 are arranged through a length corresponding to the full width $W_m$ of the recording medium 14, on the nozzle surface 200A of the head 200. The conveyance direction S of the recording medium 14 may be called the sub-scanning direction, and the direction M which is perpendicular to the conveyance direction S of the recording medium 14 may be called the main scanning direction.

In order to achieve a high density of the dot pitch formed onto the surface of the recording medium 14, it is necessary to achieve a high density of the nozzle pitch in the head 200. As shown in FIG. 12, the head 200 according to the present embodiment has a structure in which a plurality of ink chamber units (liquid droplet ejection elements forming recording element units) 208 are arranged in a matrix configuration, each ink chamber unit comprising a nozzle 202 which is an ink ejection port, a pressure chamber 204 connected to the nozzle 202 and a supply port 206 which connects the pressure chamber 204 to a common flow channel (not illustrated), whereby a high density of the nozzles is achieved by the effective nozzle interval that is obtained by projecting the nozzles in the main scanning direction, which is the lengthwise direction of the head 200 (the projected nozzle pitch indicated by the reference numeral $P_n$ in FIG. 13).

Each pressure chamber 204 connected to each nozzle 202 has an approximately square planar shape, the nozzle 202 being provided in one of two corners on the diagonal line and the supply port 206 being provided in the other corner. The shape of the pressure chamber 204 is not limited to that of the present example and various modes are possible in which the planar shape is a quadrilateral shape (diamond shape, rectangular shape, or the like), a pentagonal shape, a hexagonal shape, or other polygonal shape, or a circular shape, elliptical shape, or the like.

Figure 13:
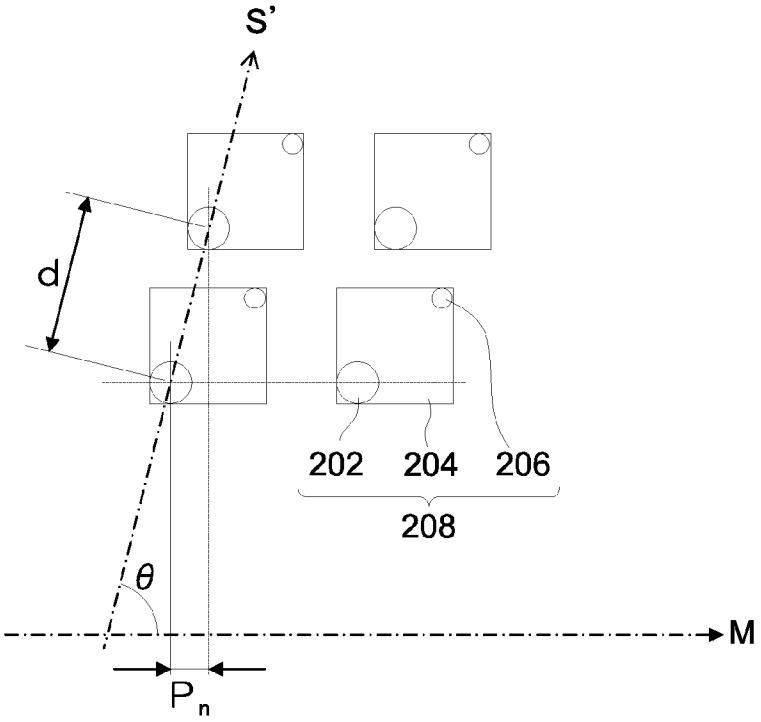
FIG. 13 is a partial enlarged diagram of the inkjet head shown in FIG. 12.

FIG. 13 is an enlarged diagram showing an enlarged view of a portion of the head 200 shown in FIG. 12. As shown in FIG. 13, the high-density nozzle head of the present embodiment is achieved by arranging ink chamber units 208 comprising a nozzle 202, pressure chamber 204, and the like, in a matrix configuration according to a prescribed arrangement pattern following a row direction aligned in the main scanning direction (indicated by reference numeral M) and an oblique column direction (indicated by reference numeral S') having a prescribed angle θ (0°<θ<90°) which is not perpendicular to the main scanning direction.

More specifically, by adopting a structure in which a plurality of ink chamber units 208 are arranged at a uniform pitch d in line with a direction forming an angle of θ with respect to the main scanning direction, the projected nozzle pitch $P_n$ of the nozzles projected to an alignment in the main scanning direction is d×cos θ, and hence it is possible to treat the nozzles 202 as if they are arranged linearly at a uniform pitch of $P_n$. By means of this composition, it is possible to achieve a high-density arrangement, in which the nozzle columns projected to an alignment in the main scanning direction reach a total of 2400 per inch (2400 nozzles per inch).

Figure 14:
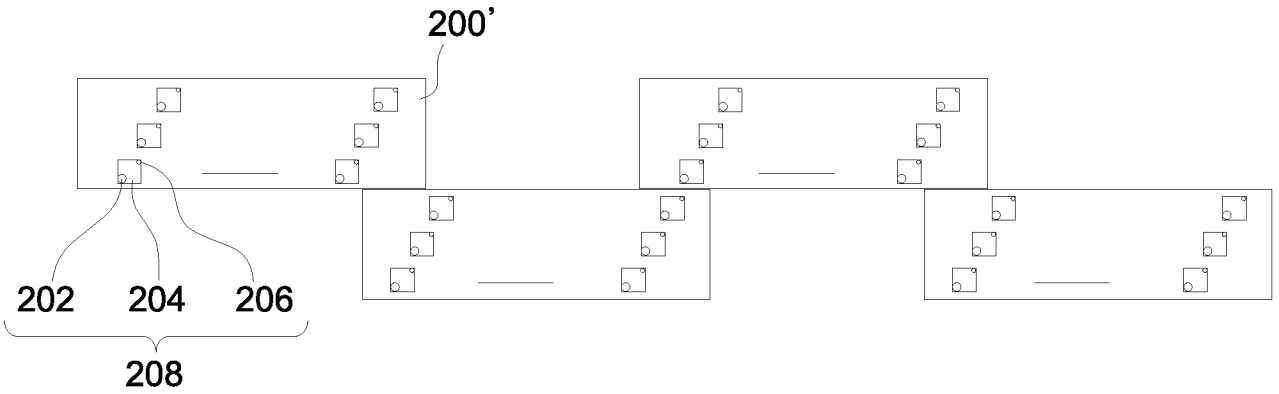
FIG. 14 is a plan view perspective diagram showing a further example of the composition of the inkjet head shown in FIG. 12.

An embodiment constituting one or more nozzle rows covering a length corresponding to the full width $W_m$ of the recording medium 14 is not limited to the present example. For example, instead of the composition in FIG. 12, as shown in FIG. 14, a line head having nozzle rows of a length corresponding to the entire width of the recording medium 14 can be formed by arranging and combining, in a staggered matrix, short head modules 200' each having a plurality of nozzles 202 arrayed in a two-dimensional fashion, to achieve a long dimension.

Figure 15:
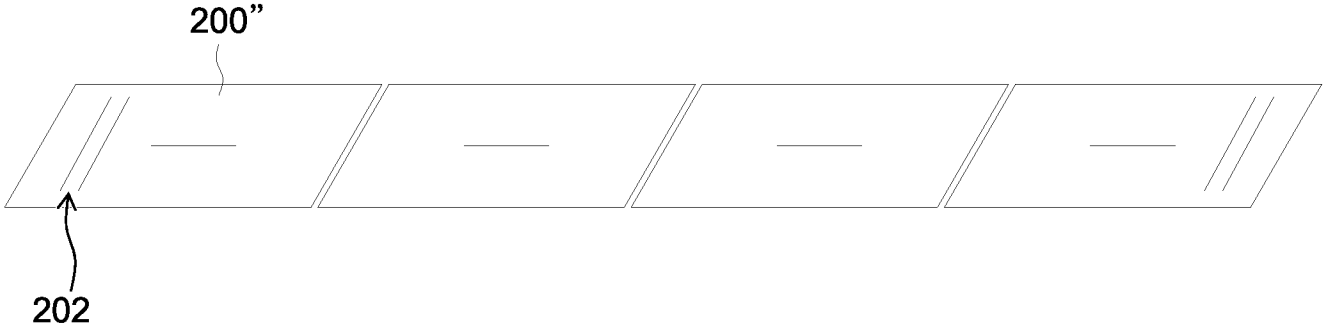
FIG. 15 is a plan view perspective diagram showing yet a further example of the composition of the inkjet head shown in FIG. 12.

Furthermore, as shown in FIG. 15, a line head may also be constituted by aligning in one row short head modules 200" which each do not cover the full width of the recording medium 14. In FIG. 15, the nozzles 202 arranged in the column direction (see FIG. 12) are indicated by the oblique solid lines.

Figure 16:
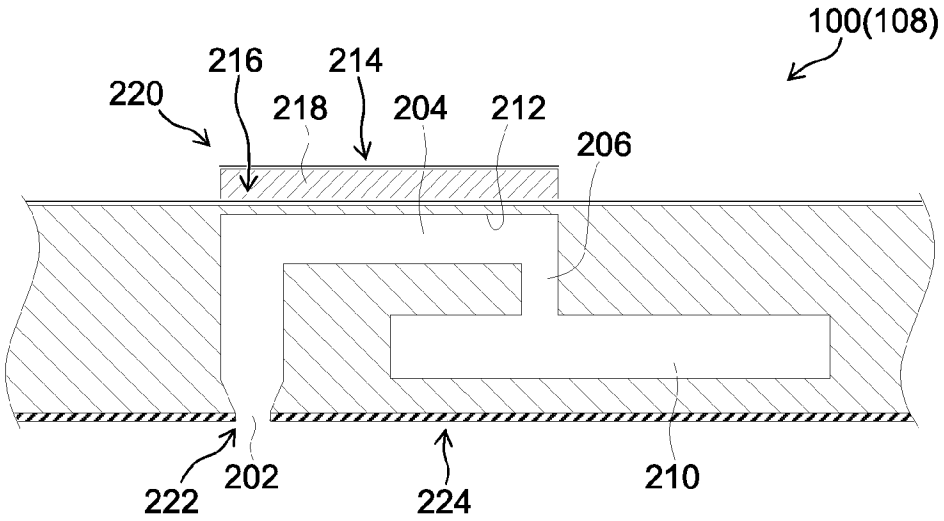
FIG. 16 is a cross-sectional diagram along line 16-16 in FIG. 12.

FIG. 16 is a cross-sectional diagram (a cross-sectional diagram along line 16-16 in FIG. 12) showing the structure of the head 200 (ink chamber unit 208) in FIG. 12.

The pressure chambers 204 which are connected to the nozzles 202 are linked via the supply ports 206 to a common flow channel 210. The common flow channel 210 is connected to an ink tank (not shown), which is a base tank that supplies ink, and the ink supplied from the ink tank is supplied through the common flow channel 210 to the pressure chambers 204.

A piezoelectric element 220 comprising an individual electrode 214 and a common electrode 216 and having a structure in which a piezoelectric body 218 is sandwiched between the individual electrode 214 and the common electrode 216 is bonded to the diaphragm 212 which constitutes the upper surface of the pressure chambers 204. Furthermore, the head 200 shown in FIG. 16 has a structure in which a nozzle plate 224 in which opening sections 222 of nozzles 202 are formed is bonded to a body in which a flow channel structure having the pressure chambers 204, supply ports 206, common flow channel 210, and the like, are formed.

The piezoelectric elements 220 and the diaphragm 212 deform when a prescribed drive voltage is applied between the individual electrodes 214 and the common electrode 216, and the volume of the pressure chambers 204 change accordingly. A pressure change occurs in the ink inside a pressure chamber 204 due to the volume change in the pressure chamber 204, and ink of a volume corresponding to the volume change in the pressure chamber 204 is ejected from the nozzle 202. After ejecting ink, when the piezoelectric element 220 and the diaphragm 212 return to their original state, new ink is filled into the pressure chamber 204 from the common flow channel 210 via the supply port 206.

In the present embodiment, the piezoelectric element 220 is used as an ink ejection force generating device, which causes the ink to be ejected from the nozzle 202 in the head 200; however, it is also possible to employ a thermal method in which a heater is provided inside the pressure chamber 204 and the ink is ejected by using the pressure of the film boiling action caused by the heating action of this heater.

Description of Control System

Figure 17:
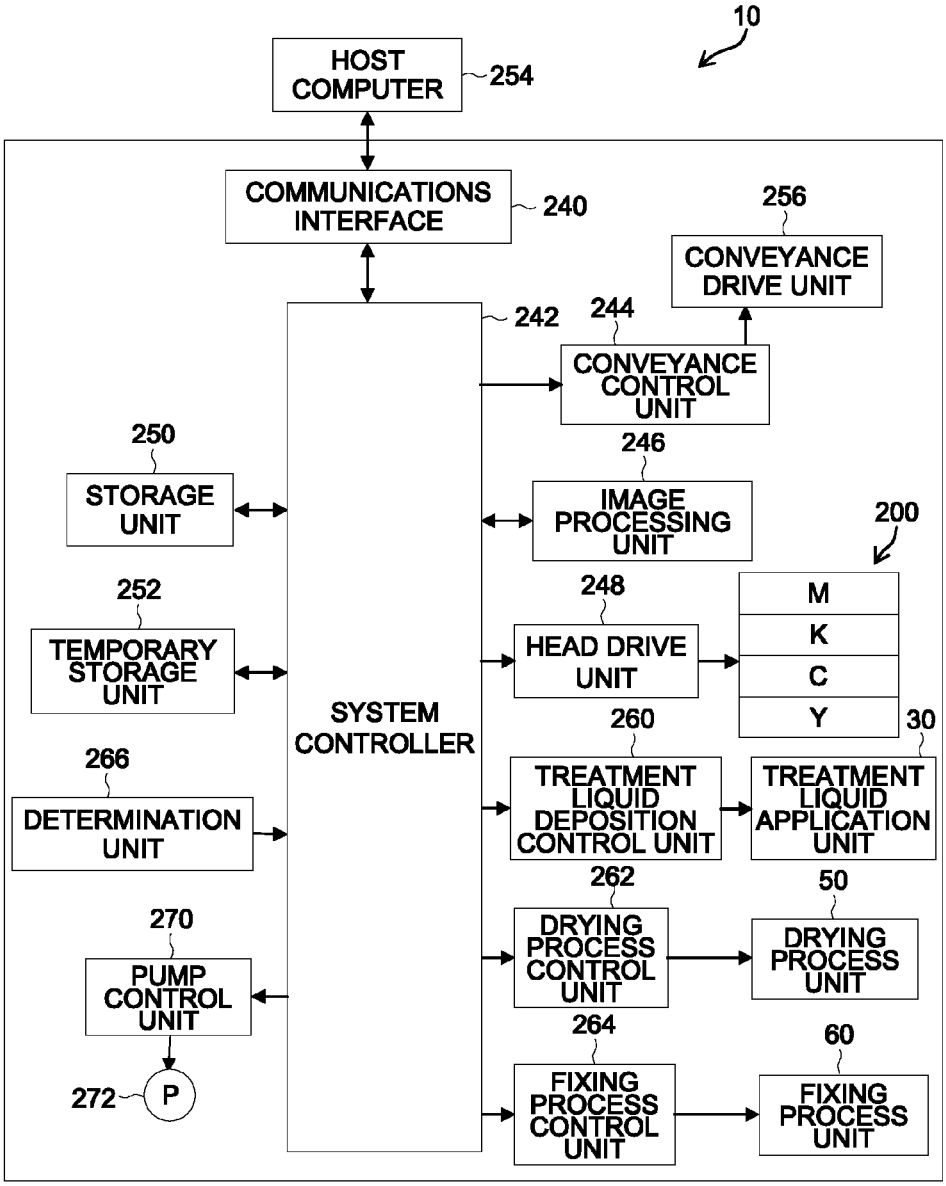
FIG. 17 is a principal block diagram showing the system composition of an inkjet recording apparatus.

FIG. 17 is a block diagram showing the approximate composition of the control system of the inkjet recording apparatus 10. The inkjet recording apparatus 10 comprises a communications interface 240, a system controller 242, a conveyance control unit 244, an image processing unit 246, and a head driving unit 248, as well as a storage unit (memory) 250 and a primary storage unit 252.

The communications interface 240 is an interface unit for receiving image data which is transmitted by a host computer 254. The communications interface 240 may employ a serial interface, such as a USB (Universal Serial Bus), or a parallel interface, such as a Centronics device. It is also possible to install a buffer memory (not illustrated) in the communications interface 240 for achieving high-speed communications.

The system controller 242 is constituted by a central processing unit (CPU) and peripheral circuits of same, and the like, and functions as a control apparatus which controls the whole of the inkjet recording apparatus 10 in accordance with a prescribed program, as well as functioning as a calculating apparatus which performs various calculations and also functioning as a memory controller for the storage unit 250 and the primary storage unit 252. In other words, the system controller 242 controls the various sections, such as the communications interface 240, the conveyance control unit 244, and the like, as well as controlling communications with the host computer 254 and read and writing to and from the storage unit 250 and the primary storage unit 252, and the like, and generating control signals which control the respective units described above.

The image data sent from the host computer 254 is input to the inkjet recording apparatus 10 via the communications interface 240, and prescribed image processing is carried out by the image processing unit 246.

The image processing unit 246 is a control unit which has signal (image) processing functions for carrying out various treatments, corrections and other processing in order to generate a signal for controlling printing from the image data, and which supplies the generated print data to the head drive unit 248. Required signal processing is carried out in the image processing unit 246 and the ejected droplet volume (droplet ejection volume) and the ejection timing of the head 200 are controlled via the head drive unit 248 on the basis of the image data. By this means, a desired dot size and dot arrangement are achieved. The head drive unit 248 shown in FIG. 17 may also include a feedback control system for maintaining uniform drive conditions in the head 200.

Furthermore, the conveyance control unit 244 controls the conveyance timing and conveyance speed of the recording medium 14 (see FIG. 1) on the basis of a print control signal generated by the image processing unit 246. The conveyance drive unit 256 in FIG. 17 includes motors which rotate the pressure drums 34 to 64 in FIG. 1, motors which rotate the transfer drums 32 to 62, a motor of the conveyance mechanism of the recording medium 14 in the paper supply unit 20, a motor which drives the tensioning roller 72A (72B) of the output unit 70, and the like, and the conveyance control unit 244 functions as a driver of the motors described above.

The storage unit 250 stores programs which is executed by the CPU of the system controller 242, and various data and control parameters, and the like, which are necessary for controlling the respective sections of the apparatus, and reading and writing of data are performed via the system controller 242. The storage unit 250 is not limited to a memory such as a semiconductor element, and may also employ a magnetic medium, such as a hard disk. Furthermore, the storage unit may also comprise an external interface and use a detachable storage medium.

The temporary storage unit (primary storage memory) 252 comprises the functions of a primary storage device for temporarily storing image data input via the communications interface 240, and the functions of a development area for various programs stored in the storage unit 250 and a calculation work area for the CPU (for example, a work area for the image processing unit 246). A volatile memory (RAM) which can be read from and written to sequentially is used as the temporary storage unit 252.

Moreover, the inkjet recording apparatus 10 comprises a treatment liquid application control unit 260, a drying process control unit 262 and a fixing process control unit 264, which respectively controls the operation of the respective sections of the treatment liquid application unit 30, the drying process unit 50, and the fixing process unit 60 including the heater 66 and the fixing roller 68 (see FIG. 1) in accordance with instructions from the system controller 242.

The treatment liquid application control unit 260 controls the timing of treatment liquid application, as well as controlling the amount of treatment liquid applied, on the basis of print data obtained from the image processing unit 246. Furthermore, the drying process control unit 262 controls the timing of the drying process, as well as controlling the process temperature, air flow volume, and the like, and the fixing process control unit 264 controls the temperature of the heater 66 as well as the application pressure of the fixing roller 68.

The determination unit 266 is a processing block which includes an in-line sensor 82 as shown in FIG. 1, and a signal processing unit for carrying out prescribed signal processing, such as noise removal, amplification, waveform shaping, and the like, of the read signal output from the in-line sensor 82. The system controller 242 judges the presence or absence of ejection abnormalities in the head 200 on the basis of the determination signal obtained by the determination unit 266.

The pump control unit 270 controls the vacuum pump 272 which generates suction pressure for securing and holding the recording medium 14 (see FIG. 1) on the pressure drums 34, 44, 54, 64 (conveyance drum 100 in FIG. 2). For example, when the recording medium which has undergone prescribed processing is supplied to the pressure drum 44 of the image formation unit 40, the vacuum pump 272 connected to the vacuum flow channel of the pressure drum 44 is operated and a vacuum (negative pressure) is generated in accordance with the type and size and the bending rigidity of the recording medium.

More specifically, when the system controller 242 acquires information about the type of recording medium, this information on the recording medium is sent to the pump control unit 270. The pump control unit 270 sets a suction pressure in accordance with the information on the recording medium, and controls the on/off switching and the generated pressure of the vacuum pump 272 in accordance with this setting.

For example, if using a recording medium having low bending rigidity, such as thin paper, the suction pressure is set lower than standard, and if using a recording medium having high bending rigidity, such as thick paper, the suction pressure is set higher than standard. Furthermore, depending on the thickness of the recording medium, if a thick recording medium is used, then the suction pressure is set higher than standard and if a thin recording medium is used, then the suction pressure is set lower than standard. A data table is desirably created by associating the type of recording medium (e.g. thickness and bending rigidity) with the suction pressure, and this table is desirably stored in a prescribed memory (for example, the storage unit 250 in FIG. 17).

FIG. 17 shows only one vacuum pump 272, but it is also possible to provide a vacuum pump 272 with respect to each of the pressure drums 34, 44, 54, 64, or to provide a switching device, such as a control valve, at an intermediate point of the vacuum flow channel and perform selective switching using one vacuum pump so as to correspond to a plurality of pressure drums.

A desirable mode is one where the conveyance drum 100 shown in the present embodiment separately comprises an individual vacuum pump for the leading end region of the recording medium and an individual vacuum pump for the other region. According to this mode, the suction pressure applied to the leading end portion of the recording medium is able to reliably hold the leading end portion of the recording medium without being affected by the suction pressure applied to substantially the central portion of the recording medium, and the like.

According to the inkjet recording apparatus 10 having the composition described above, a first leading end suction groove 152 and a second leading end suction groove 156 are provided in the leading end region holding section 110 which holds the leading end region of the recording medium 14, in each of the pressure drums 34, 44, 54, 64 (conveyance drums 100) which convey the recording medium 14 in a prescribed direction while holding the recording medium 14, and the first leading end suction groove 152 and the second leading end suction groove 156 are connected to the vacuum pump 272 via a different path to the other suction grooves 166; therefore, it is possible to suction the leading end region of the recording medium 14 more strongly, and folding or floating up of the leading end region of the recording medium is prevented.

Moreover, by providing a leading end drum groove 134 which connects with the first leading end suction groove 152 and the second leading end suction groove 156, and also dividing the first leading end suction groove 152 and the second leading end suction groove 156 in the drum axial direction, it is possible to achieve compatibility with a greater number of different sizes of recording medium.

Since the flow channel resistance of the restrictor sections 154 which connect the first suction groove 152 with the leading end drum groove 134 is less than the flow channel resistance of the restrictor sections 158 which connect the second leading end suction groove 156 with the leading end drum groove 134, then it is possible to make the suction pressure applied to the leading end side of the recording medium greater compared to the central portion.

MODIFICATION EXAMPLE OF MEDIUM HOLDING APPARATUS

Next, modification examples of the medium holding apparatus (conveyance drum 100) described with reference to FIG. 2 to FIG. 10 will be explained.

First Modification Example

Figure 18:
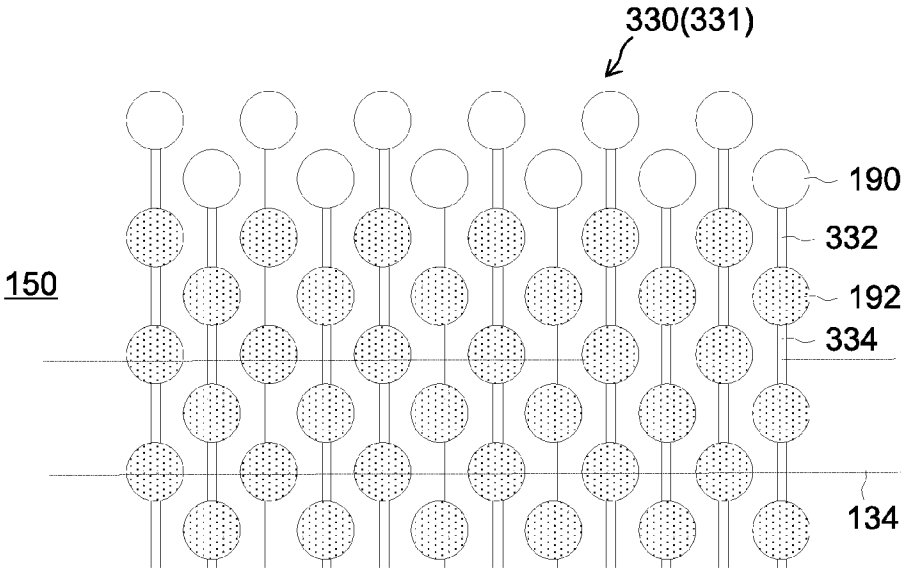
FIG. 18 is a partial enlarged diagram of a suction sheet showing the structure of a suction sheet relating to a first modification example.
Figure 19:
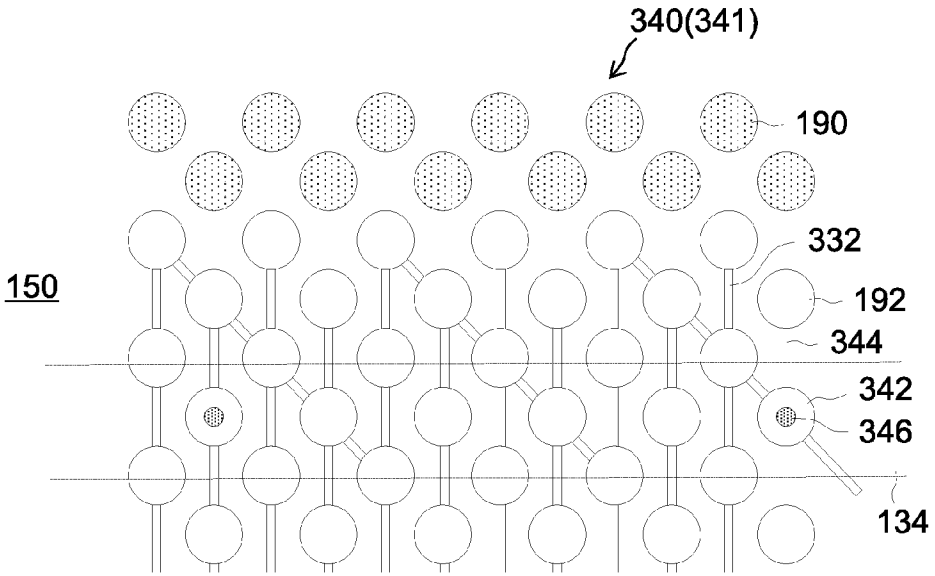
FIG. 19 is a partial enlarged diagram of a suction sheet showing the structure of a suction sheet relating to a second modification example.
Figure 20:
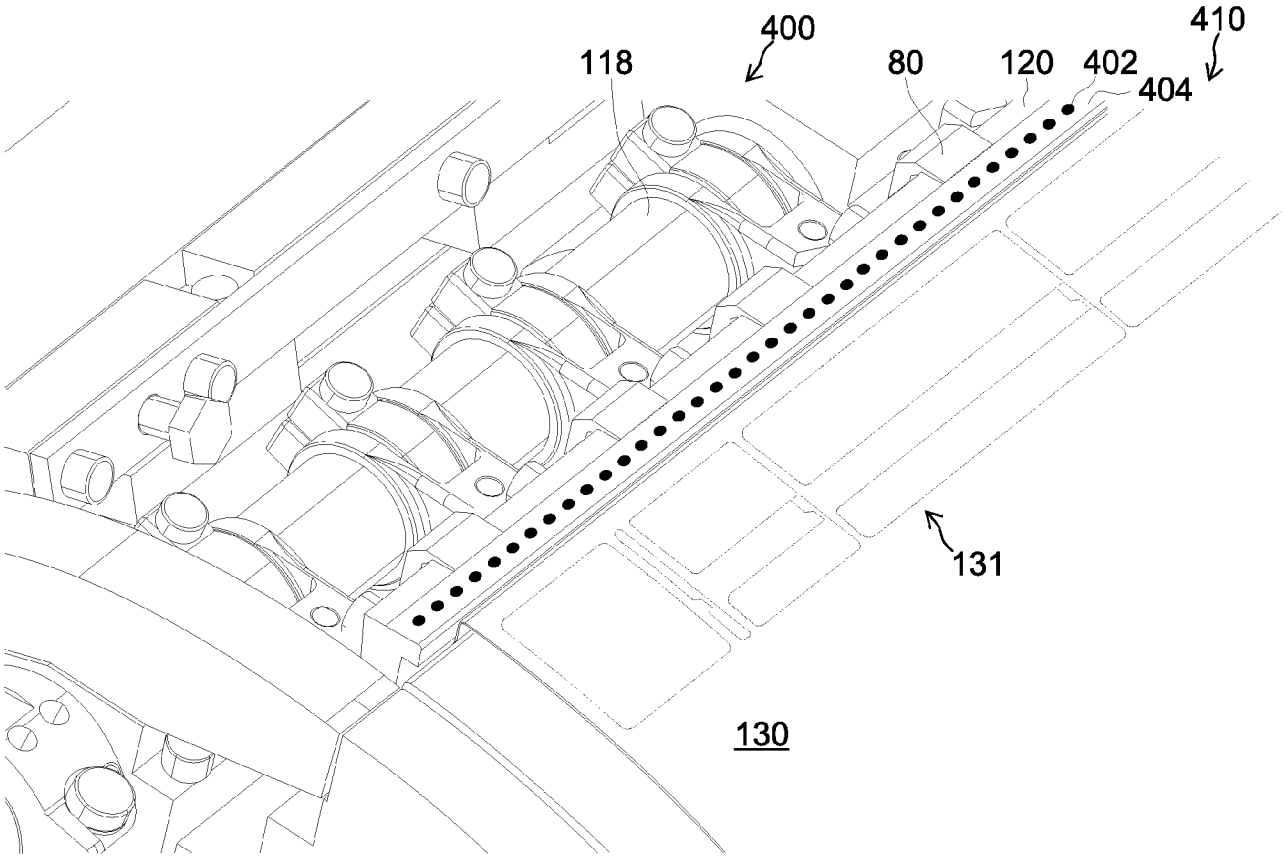
FIG. 20 is a partial enlarged diagram of a conveyance drum showing the composition of a conveyance drum relating to a third modification example.
Figure 21:
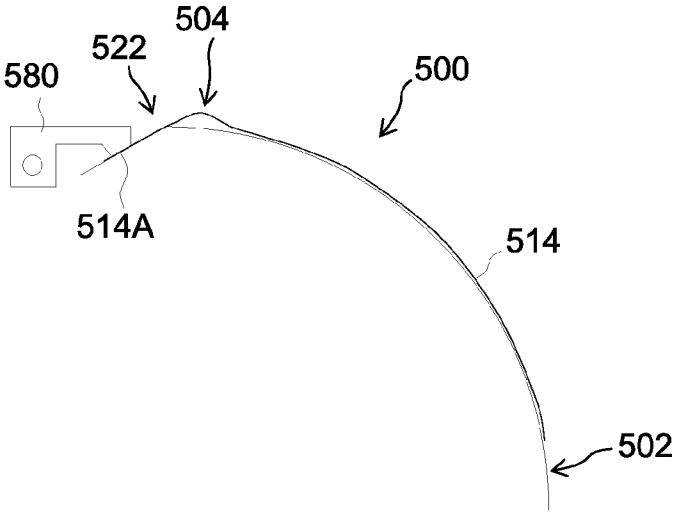
FIG.21 RELATED ART
FIG. 21 is a diagram for describing problems associated with the related art.

FIG. 18 is a partial enlarged drawing of a suction sheet 330 according to a first modification example. FIG. 18 is a plan diagram showing the periphery of the leading end suction portion 331 of the suction sheet 330, as viewed from the front surface side. In FIG. 18 and FIG. 19 and FIG. 20, which are described below, portions which are the same as or similar to parts described already are labelled with the same reference numerals and description thereof is omitted here.

As shown in the drawings, first auxiliary suction grooves 332 are provided which connect the suction apertures 190 that are connected to the first leading end suction groove 152 and the second leading end suction groove 156 (not shown in FIG. 18; see FIGS. 7 and 8) with the recess sections 192 that are provided in the closed portion 112, and furthermore, second auxiliary suction grooves 334 connecting the recess sections 192 with each other are provided.

By connecting the suction apertures 190 and the recess sections 192 by means of the first auxiliary suction grooves 332, and connecting together the respective recess sections 192, it is possible to generate a suction pressure in the plurality of recess sections 192 which are provided in the closed portion 112, and the leading end portion of the recording medium 14 (not shown in FIG. 18; see FIG. 1) can be suctioned and held more strongly.

Although the suction pressure which can be generated in each recess section 192 is very slight, a merit is obtained in that only a small fall in the suction pressure occurs when using a recording medium of small size.

From the viewpoint of preventing deformation of the recording medium and ensuring the rigidity of the suction sheet 330, the groove width of the first auxiliary suction grooves 332 and the second auxiliary suction grooves 334 is desirably made smaller than the diameter of the suction apertures 190 and the recess sections 192 (if the planar shape of the suction apertures 190 and the recess sections 192 is a substantially round shape). In the mode shown in FIG. 18, the groove width of the first auxiliary suction grooves 332 and the second auxiliary suction grooves 334 is approximately ⅕ (one-fifth) the diameter of the suction apertures 190 (recess sections).

Furthermore, the depth of the first auxiliary suction grooves 332 and the second auxiliary suction grooves 334 should be less than the thickness of the suction sheet (a depth which does not pass through the suction sheet 330), and may be substantially the same as the depth of the recess sections 192.

FIG. 18 shows the first auxiliary suction grooves 332 and the second auxiliary suction grooves 334 connecting in a straight line shape between the suction apertures 190 and the recess sections 192 which are disposed following the drum circumferential direction, but it is also possible to adopt a mode in which the first auxiliary suction grooves 332 and the second auxiliary suction grooves 334 connect together recess sections 192 which are disposed following the drum axial direction or connect suction apertures 190 and recess sections 192 which are arranged following an oblique direction that intersects with the drum axial direction or the drum circumferential direction.

Second Modification Example

Next, a second modification example of the present invention will be described. FIG. 19 is a partial enlarged diagram of a suction sheet 340 relating to the second modification example and provides a plan diagram of the vicinity of the leading end suction portion 341 of the suction sheet 340, as viewed from the front surface side.

In the mode shown in FIG. 19, recess sections 342 which connect with the leading end drum groove 134 are provided in one portion of the recess sections 192 provided in the closed portion 112 (not shown in FIG. 19; see FIG. 7 and FIG. 8) and furthermore, third auxiliary suction grooves 344 which connect the recess sections 342 that are connected to the leading end drum groove 134 with the recess sections 192 which are not connected to the leading end drum groove 134, and second auxiliary suction grooves 334 which connect respective recess sections 192 with each other, are also provided.

The recess sections 342 are provided at positions which correspond to the leading end drum groove 134 provided on the drum main body (directly above the leading end drum groove 134) when the suction sheet 340 is superimposed over the drum main body 136 (not shown in FIG. 18; see FIG. 5), and connect with the leading end drum groove via auxiliary connection apertures 346.

The auxiliary connection apertures 346 have a diameter smaller than the diameter of the recess sections 342 and have a structure which reduces air leakage from the recess sections 342. In the mode depicted, the diameter of the auxiliary connection apertures 346 is approximately ⅓ (one-third) the diameter of the recess sections 342, and the auxiliary connection apertures 346 are provided in substantially the central portion of the recess sections 342.

According to this mode, it is possible to generate a suction pressure in the recess sections 342 and the recess sections 192 which are provided in the closed portion 112 of the suction sheet 130, and the leading end portion of the recording medium 14 (not shown in FIG. 19, see FIG. 1) can be suctioned more strongly. Furthermore, there is also a merit in that the suction pressure generated in the recess sections 342 is large compared to the mode shown in FIG. 17.

In order to suppress air leakage from the recess sections 342 as far as possible, desirably, the number of recess sections 342 which connect to the leading end drum groove 134 is kept to a minimum. Furthermore, it is also possible to use the first auxiliary suction grooves 332 which connect the suction apertures 190 with the recess sections 192 as shown in FIG. 18.

Third Modification Example

Next, a third modification example of the present invention will be described. FIG. 20 is a partially enlarged view of a conveyance drum 400 relating to the third modification example, which shows an enlarged view of the leading end holding section 410 which holds the leading end region of the recording medium 14 (not shown in FIG. 20; see FIG. 1).

As shown in FIG. 20, a plurality of auxiliary suction apertures 402 are provided between the gripper 80 which grips the leading end of the recording medium and the leading end suction portion 131 of the suction sheet 130. The auxiliary suction apertures 402 are provided in the outer side portion 404, in terms of the drum circumferential direction, with respect to the position of the hook base 120 against which the hook portion 80D of the gripper 80 abuts (not shown in FIG. 20, see FIG. 3), and a vacuum pump (not shown in FIG. 20, see FIG. 17) is connected to these auxiliary suction apertures 402 via a vacuum flow channel, which is not illustrated.

In FIG. 20, a plurality of auxiliary suction apertures 402 are arranged equidistantly in one row throughout a length corresponding to the maximum width of the recording medium in the drum axial direction.

According to this mode, by providing auxiliary suction apertures 402 between the gripper 80 and the suction apertures 190, it is possible to suction the leading end portion of the recording medium more strongly. In particular, when using a recording medium having large thickness, floating up is liable to occur in the perimeter edge portions of the recess section 122 of the conveyance drum 400, and even in cases such as these, the recording medium can be suctioned reliably.

Other Modification Examples

The description given above relates to an example of a single integrated suction sheet, in which suction apertures 190 are formed in one surface of one suction sheet 130, and a first leading end suction groove 152, a second leading end suction groove 156, suction grooves 166, restrictor sections 154, 158, 178 and ribs 162, 164, 168 are formed in the other surface of the sheet, but the implementation of the present invention is not limited to this example.

For example, it is also possible to adopt a mode in which a first sheet corresponding to the suction aperture layer 194 and a second sheet (intermediate sheet) corresponding to the flow channel groove forming layer 196 are composed separately and are layered together. Furthermore, the structure is not limited to one where a suction sheet 130 is wrapped about a drum main body 136 as described in the aforementioned embodiments as an example, and the drum main body 136 and the suction sheet 130 may also be composed as a single body.

In the embodiment described above, a first leading end suction groove 152, a second leading end suction groove 156 and suction grooves 166 are formed in the rear surface side of the suction sheet 130, but if the groove width of the suction grooves is sufficiently narrow, then it is also possible to adopt a mode in which the suction grooves are formed in the front surface of the suction sheet 130 (the medium holding surface side which makes contact with the recording medium). For example, in the mode described in FIG. 9A, the suction apertures 190 (suction aperture layer 194 in FIG. 10) are omitted, and a mode can be adopted in which the first leading end suction groove 152, the second leading end suction groove 156 and the suction grooves 166 are exposed on the medium holding surface. In this case, the upper surfaces of the restrictor sections 154, 158 and 178 are closed off. In a composition of this kind, the first leading end suction groove 152, the second leading end suction groove 156 and the suction grooves 166 function as suction apertures 190. For example, in the composition shown in FIG. 18, the first auxiliary suction grooves 332 which connect the recess sections 192 and the suction apertures 190 are connected to the first leading end suction groove 152 or the second leading end suction groove 156.

As in the embodiment described above, the present invention is effective in a drum-shaped (rotating body-shaped) medium holding apparatus, such as a pressure drum, but the range of application of the present invention is not limited to this and may also be applied to a linear motion system, such as a belt-shaped member or a flat bed type of medium holding apparatus.

In the embodiment described above, a case has been given where the suction force to the leading end portion of the paper is strengthened, but a similar composition can also be applied to other end portions apart from the leading end portion, for instance, the trailing end portion or the lateral end portions of the paper.

Example of Application to Other Apparatus Compositions

In the embodiment described above, the inkjet recording apparatus has been described as an example of an image forming apparatus, but the scope of application of the present invention is not limited to this, and may also be applied to an image forming apparatus based on a method other than an inkjet method, such as a laser recording method or electrophotographic method, or the like. For example, it is also possible to apply the present invention to color image recording apparatuses of various types, such as a thermal transfer recording apparatus equipped with a recording head that uses thermal elements as recording elements, an LED electrophotographic printer equipped with a recording head having LED elements as recording elements, or a silver halide photographic printer having an LED line type exposure head, or the like.

Furthermore, the meaning of the term "image forming apparatus" is not restricted to a so-called graphic printing application for printing photographic prints or posters, but rather also encompasses industrial apparatuses which are able to form patterns that may be perceived as images, such as resist printing apparatuses, wire printing apparatuses for electronic circuit substrates, ultra-fine structure forming apparatuses, or the like.

Appendix

As has become evident from the detailed description of the embodiments given above, the present specification includes disclosure of various technical ideas described below.

One aspect of the present invention is directed to a medium holding apparatus, comprising: a medium holding conveyance device which has a plurality of suction grooves for suctioning a sheet-shaped medium, and conveys the medium in a prescribed direction while holding the medium on a medium holding surface; and a suction pressure generating device which is connected to the plurality of suction grooves, and generates suction pressure in each of the suction grooves, wherein: the plurality of suction grooves include a leading end suction groove provided at a position where a leading end region of the medium is held, and the leading end suction groove has a structure so as to be separated from other suction grooves of the plurality of suction grooves, and is connected to the suction pressure generating device via a flow channel which is not connected to the other suction grooves.

According to this aspect of the present invention, in a medium holding apparatus comprising a plurality of suction grooves which suction a medium, since a leading end suction groove which suctions the leading end region of the medium is provided, and the leading end suction groove is separate from the other suction grooves and is connected to a suction pressure generating device via a flow channel which is not connected to the other suction grooves, then it is possible to hold the leading end region of the medium more reliably, without being affected by variations in the suction pressure in the other suction grooves, and the like. Consequently, folding or floating up of the leading end region of the medium is prevented.

The "leading end region of the medium" is a region of a prescribed length in the conveyance direction from the leading end of the medium, and is a region where floating up of the medium is liable to occur due to the leading end of the medium being gripped, for example.

The present invention can be applied to sheet-shaped media of various types and materials, such as paper, resin sheets, metal sheets, and the like. For example, even if using thick paper or stiff media, it is possible to hold the media with a strong suction pressure.

Desirably, the medium holding apparatus further comprises a restrictor section which is provided between the leading end suction groove and the suction pressure generating device, and has a structure which restricts a flow volume in the leading end suction groove and in which the medium holding surface is closed off.

According to this mode, since the flow volume in the leading end suction groove is restricted and a restrictor section having a structure which is not open to the medium holding surface is provided, then even if one portion of the leading end suction groove is open to the atmosphere, it is possible to apply a prescribed suction pressure to the medium without the occurrence of significant reduction in the suction pressure.

The "structure which restricts the flow volume" in this mode of the invention includes a flow channel structure having a cross-sectional area smaller than the cross-sectional area of the leading end suction groove, and is a structure having a function for avoiding the escape of the pressure suctioning the medium due to the occurrence of pressure loss in the suction grooves which are open to the air.

The restrictor sections are of a structure having a function of restricting the suction pressure (negative pressure) applied to the medium, and a desirable mode is one where each restrictor section is disposed in one end portion of each of the suction grooves.

For example, the restrictor sections are composed by forming flow channel sections of narrow width in such a manner that the width of one end portion of each suction groove becomes narrower than the other portions thereof. One restrictor section may be provided to correspond to one suction groove, or a common restrictor section may be provided for a plurality of suction grooves.

Furthermore, a "structure whereby the medium holding surface is closed off" means a structure in which the openings of the restrictor sections are not exposed on the medium holding surface. For example, a possible mode is one where an opening section of the leading end suction groove is provided on the medium holding surface, the width of the leading end suction groove is made narrow, this portion of narrow groove width is closed off so as not to be exposed on the medium holding surface, and this portion of small groove width where the medium holding surface is closed off is taken as a restrictor section.

Desirably, the leading end suction groove is divided into regions in accordance with widths of media of a plurality of types in a breadthways direction which is substantially perpendicular to the prescribed direction in which the medium is conveyed, and the restrictor section is provided individually for each of the divided regions of the leading end suction groove.

According to this mode, it is possible to reduce the pressure loss in either end portion of the leading end suction groove in the breadthways direction of the medium, and a uniform suction pressure can be generated throughout the whole of the breadthways direction of the medium.

Furthermore, it is possible to achieve compatibility with a plurality of recording medium widths, loss of suction pressure when using a medium of small width is suppressed, and furthermore, floating up of the medium due to insufficient suction pressure when using a medium of large width is prevented.

Moreover, there is no need to switch the flow channel of the suction pressure in response to media of different sizes, or the like, and the apparatus composition is therefore simplified.

Desirably, the medium holding apparatus further comprises a pressure generating section which is connected to each of the divided regions of the leading end suction groove via the restrictor section provided individually for each of the divided regions of the leading end suction groove, has a groove shape formed in the breadthways direction of the medium, and has a structure in which the medium holding surface is closed off.

According to this mode, it is possible to obtain a storage suction pressure even when suctioning a medium of small size (width).

Desirably, the leading end suction groove includes a first leading end suction groove provided on a leading end side of the medium with respect to the pressure generating section.

According to a composition of this kind, since it is possible to apply a strong suction pressure to the leading end portion of the medium in particular, then folding or floating up of the leading end of the medium can be prevented effectively.

Desirably, the leading end suction groove includes a second leading end suction groove provided on a central side of the medium with respect to the pressure generating section, and a flow channel resistance of a first restrictor section corresponding to the first leading end suction groove is less than a flow channel resistance of a second restrictor section corresponding to the second leading end suction groove.

According to this mode, it is possible to supply a greater flow volume to the leading end region of the medium where the first leading end suction groove is provided and folding or floating up of the leading end of the medium is prevented.

Desirably, recess sections are provided in a closed portion of the medium holding surface.

According to this mode, temperature distribution occurring between the closed portion and the open portion of the medium holding surface (the open portion being the region where the suction grooves are provided) is suppressed and a uniform temperature can be achieved throughout the whole medium.

Desirably, the medium holding apparatus further comprises first auxiliary suction grooves which connect the recess sections and the suction grooves.

According to this mode, it is possible to generate a suction pressure even in the closed portion where suction grooves are not provided, and therefore partial floating up of the medium can be prevented effectively.

In a mode where a suction aperture which connects with the suction groove is provided in the medium holding surface, a first auxiliary suction groove connects the suction aperture and a recess section.

Desirably, the recess sections include first recess sections having a structure to connect with auxiliary connection apertures having an opening surface area less than an opening surface area of the recess sections and connecting the recess sections with the suction pressure generating device.

A desirable mode in this case is one where an auxiliary connection aperture is provided in a recess section provided directly above the pressure generating section.

Desirably, the recess sections include second recess sections which are not connected to the auxiliary connection apertures, and the medium holding apparatus further comprises secondary auxiliary connection grooves which connect the first recess sections and the second recess sections, and third auxiliary connection grooves which connect the second recess sections with each other.

According to this mode, partial floating up of the medium is prevented and the medium can be held reliably.

Desirably, auxiliary suction apertures for applying suction pressure to the leading end region of the medium are provided on a medium leading end side of the leading end suction groove.

According to this mode, it is possible to suction the leading end region of the medium more strongly, and folding or floating up of the leading end region of the medium is prevented.

Desirably, the medium holding conveyance device comprises: a sheet-shaped member in which the plurality of suction grooves and the restrictor section are formed; and a main body section in which the suction pressure generating device connected to the plurality of suction grooves is formed, wherein the sheet-shaped member is superimposed over the main body section.

By forming suction grooves and restrictor sections in a sheet-shaped member and adopting a structure in which the sheet-shaped member is superimposed on the main body section of the medium holding device, it is possible readily to form a complicated three-dimensional structure including flow channels which connect to the suction pressure generating device.

Desirably, the sheet-shaped member has a rear surface side which contacts the main body section and on which the plurality of suction grooves are formed, and a front surface which forms a medium holding surface and on which a plurality of suction apertures connected to the suction grooves are formed.

According to this mode, the suction pressure generating device generates suction pressure in suction apertures, rather than in suction grooves.

A desirable mode in this case is one where dummy recess sections which are the same as or similar to the suction apertures are provided in the region where the suction apertures are not formed. According to a mode where such dummy recess sections are formed, the rigidity of the sheet-shaped member does not become uneven, and the formation of partial recesses is prevented.

Desirably, the medium holding conveyance device has a drum shape having a cylindrical circumferential surface and suctions and holds the medium on the cylindrical circumferential surface.

According to this mode, in a mode where a sheet-shaped medium is bent and held about a circumferential surface (curved surface) of a drum, there is a possibility that the medium is liable to float up from the circumferential surface (medium holding surface) of the drum due to the force seeking to return the medium to its original shape, but the this aspect of the invention is effective in respect of floating up of this kind.

Desirably, a gripper which grips a leading end of the medium is provided in the medium holding conveyance device, and the gripper has a structure which does not project from the medium holding surface.

According to this mode, it is possible to prevent detachment of the leading end portion of the medium by gripping the leading end portion of the medium with a gripper. Furthermore, by adopting a structure in which the gripper does not project to the medium holding surface, contact between the gripper and the structure provided in the vicinity of the circumferential surface of the drum is prevented.

Another aspect of the invention is directed to an image forming apparatus, comprising: the medium holding apparatus; and a recording head for recording an image on the medium.

According to this aspect of the present invention, it is possible to hold various media, including media of high stiffness, on the medium holding surface of the medium holding device, and high-quality image formation is possible.

The inkjet recording apparatus which is one mode of the image forming apparatus according to the present invention includes: a liquid ejection head (recording head) in which a plurality of liquid droplet ejection elements are arranged at high density, each liquid droplet ejection element having a nozzle (ejection port) for ejecting an ink droplet in order to form a dot and a pressure generating device (piezoelectric element or heating element for heating for bubble generation) which generates an ejection pressure; and an ejection control device which controls the ejection of liquid droplets from the liquid ejection head on the basis of ink ejection data (dot image data) generated from an input image. An image is formed on a recording medium by means of the liquid droplets ejected from the nozzles.

For example, color conversion and halftone processing are carried out on the basis of the image data (print data) input through the image input device, and ink ejection data corresponding to the ink colors is generated. The driving of the pressure generating elements corresponding to the respective nozzles of the liquid ejection head is controlled on the basis of this ink ejection data, and ink droplets are ejected from the nozzles.

In order to achieve high-resolution image output, a desirable mode is one using a recording head in which a large number of liquid droplet ejection elements (ink chamber units) are arranged at high density, each liquid droplet ejection element having a nozzle (ejection port) which ejects ink liquid, a pressure chamber corresponding to the nozzle, and a pressure generating device.

A compositional example of a recording head based on an inkjet method of this kind is a full line type head having a nozzle row in which a plurality of ejection ports (nozzles) are arranged through a length corresponding to the full width of the recording medium. In this case, a mode may be adopted in which a plurality of relatively short ejection head modules having nozzles rows which do not reach a length corresponding to the full width of the recording medium are combined and joined together, thereby forming nozzle rows of a length that correspond to the full width of the recording medium.

A full line type head is usually disposed in a direction that is perpendicular to the relative feed direction (relative conveyance direction) of the recording medium, but a mode may also be adopted in which the head is disposed following an oblique direction that forms a prescribed angle with respect to the direction perpendicular to the conveyance direction.

The conveyance device for causing the recording medium and the recording head to move relative to each other may include a mode where the recording medium is conveyed with respect to a stationary (fixed) head, or a mode where a head is moved with respect to a stationary recording medium, or a mode where both the head and the recording medium are moved. When forming color images by means of an inkjet recording head, it is possible to provide a recording head for each color of a plurality of colored inks (recording liquids), or it is possible to eject inks of a plurality of colors, from one recording head.

The term "recording medium" includes various types of media, irrespective of material and size, such as continuous paper, cut paper, sealed paper, resin sheets, such as OHP sheets, film, cloth, a printed circuit board on which a wiring pattern, or the like, is formed, and an intermediate transfer medium, and the like.

Possible modes of the conveyance device are a conveyance drum (conveyance roller) having a cylindrical shape which is able to rotate about a prescribed rotational axis, or a conveyance belt, or the like. The medium holding apparatus according to the present invention can be used as a recording medium holding device in such a conveyance device.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A medium holding apparatus, comprising:

a medium holding conveyance device which has a plurality of suction grooves for suctioning a sheet-shaped medium, and conveys the medium in a prescribed direction while holding the medium on a medium holding surface, wherein the plurality of suction grooves include a leading end suction groove provided at a position where a leading end of the sheet-shaped medium is held;

a suction pressure generating device which is connected to the plurality of suction grooves, and generates suction pressure in each of the suction grooves; and a restrictor section which is provided between the leading end suction groove and the suction pressure generating device in a manner such that the restrictor section is provided with respect to a corresponding divided region of the leading end suction groove and that each divided region is connected to a leading end groove of the medium holding conveyance device via the restrictor section, and has a structure which restricts a flow volume in the leading end suction groove and in which the medium holding surface is closed off;

wherein:

the leading end suction groove has a structure so as to be separated from other suction grooves of the plurality of suction grooves, and is connected to the suction pressure generating device via a flow channel which is not connected to the other suction grooves, and in a state that the medium is not held, the restrictor section is closed by a closed portion; and wherein the suction pressure generating device generates suction pressure in the leading end suction groove greater than suction pressure in the other suction grooves.

2. The medium holding apparatus as defined in claim 1, wherein the leading end suction groove is divided into regions in accordance with widths of media of a plurality of types in a breadthways direction which is substantially perpendicular to the prescribed direction in which the medium is conveyed, and the restrictor section is provided individually for each of the divided regions of the leading end suction groove.

3. The medium holding apparatus as defined in claim 2, further comprising a pressure generating section which is connected to each of the divided regions of the leading end suction groove via the restrictor section provided individually for each of the divided regions of the leading end suction groove, has a groove shape formed in the breadthways direction of the medium, and has a structure in which the medium holding surface is closed off.

4. The medium holding apparatus as defined in claim 3, wherein the leading end suction groove includes a first leading end suction groove provided on a leading end side of the medium with respect to the pressure generating section.

5. The medium holding apparatus as defined in claim 4, wherein:

the leading end suction groove includes a second leading end suction groove provided on a central side of the medium with respect to the pressure generating section, and a flow channel resistance of a first restrictor section corresponding to the first leading end suction groove is less than a flow channel resistance of a second restrictor section corresponding to the second leading end suction groove.

6. The medium holding apparatus as defined in claim 1, wherein recess sections are provided in a closed portion of the medium holding surface.

7. The medium holding apparatus as defined in claim 6, further comprising first auxiliary suction grooves which connect the recess sections with the suction grooves.

8. The medium holding apparatus as defined in claim 6, wherein the recess sections include first recess sections having a structure to connect with auxiliary connection apertures having an opening surface area less than an opening surface area of the recess sections and connecting the recess sections with the suction pressure generating device.

9. The medium holding apparatus as defined in claim 8, wherein:

the recess sections include second recess sections which are not connected to the auxiliary connection apertures, and the medium holding apparatus further comprises secondary auxiliary connection grooves which connect the first recess sections with the second recess sections, and third auxiliary connection grooves which connect the second recess sections with each other.

10. The medium holding apparatus as defined in claim 1, wherein auxiliary suction apertures for applying suction pressure to the leading end region of the medium are provided on a medium leading end side of the leading end suction groove.

11. The medium holding apparatus as defined in claim 1, wherein the medium holding conveyance device includes:

a sheet-shaped member in which the plurality of suction grooves and the restrictor section are formed; and a main body section in which the suction pressure generating device connected to the plurality of suction grooves is fowled, wherein the sheet-shaped member is superimposed over the main body section.

12. The medium holding apparatus as defined in claim 11, wherein the sheet-shaped member has a rear surface side which contacts the main body section and on which the plurality of suction grooves are formed, and a front surface which forms a medium holding surface and on which a plurality of suction apertures connected to the suction grooves are formed.

13. The medium holding apparatus as defined in claim 1, wherein the medium holding conveyance device has a drum shape having a cylindrical circumferential surface, and suctions and holds the medium on the cylindrical circumferential surface.

14. The medium holding apparatus as defined in claim 1, wherein:

a gripper which grips a leading end of the medium is provided in the medium holding conveyance device, and the gripper has a structure which does not project from the medium holding surface.

15. An image forming apparatus, comprising:

the medium holding apparatus as defined in claim 1; and a recording head for recording an image on the medium.

16. The medium restriction section of claim 1, wherein a cross-sectional area of the restrictor section is smaller than a cross-sectional area of the leading end suction groove.

17. The medium restriction section of claim 1, wherein the restrictor section is formed by making a portion of the leading end suction groove narrower than a width of the other portions of the suction groove.

18. The medium restriction section of claim 1, wherein the restrictor section is formed following the medium conveyance direction from the leading end suction groove.

19. The medium restriction section of claim 1, wherein the suction pressure generating device comprises:

a first suction pressure generating device which generates suction pressure in the leading end suction groove; and a second suction pressure generating device which generates suction pressure in the other suction grooves.

* * * * *